US009783961B2

(12) United States Patent
Ikegami et al.

(10) Patent No.: US 9,783,961 B2
(45) Date of Patent: Oct. 10, 2017

(54) APPARATUS AND METHOD FOR ASSISTING HYDRAULIC CYLINDER STROKE INITIAL CALIBRATION WORK

(71) Applicant: Komatsu Ltd., Tokyo (JP)

(72) Inventors: Katsuhiro Ikegami, Hiratsuka (JP); Yoshiki Kami, Hadano (JP); Yuki Shimano, Hirakata (JP); Hayato Matsumoto, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 519 days.

(21) Appl. No.: 14/127,263

(22) PCT Filed: Apr. 12, 2013

(86) PCT No.: PCT/JP2013/061120
§ 371 (c)(1),
(2) Date: Jul. 24, 2014

(87) PCT Pub. No.: WO2014/167731
PCT Pub. Date: Oct. 16, 2014

(65) Prior Publication Data

US 2014/0326039 A1 Nov. 6, 2014

(51) Int. Cl.
*E02F 9/26* (2006.01)
*E02F 9/22* (2006.01)
(Continued)

(52) U.S. Cl.
CPC ..... *E02F 9/264* (2013.01); *E02F 9/2271* (2013.01); *E02F 9/267* (2013.01); *F15B 15/2815* (2013.01); *F15B 19/002* (2013.01)

(58) Field of Classification Search
None
See application file for complete search history.

(56) References Cited

U.S. PATENT DOCUMENTS 8,321,114 B2 11/2012 Kamado et al.
2005/0273288 A1 12/2005 Yamamoto et al.
2010/0281969 A1 11/2010 Seidel et al.

FOREIGN PATENT DOCUMENTS

CN 1837517 A 9/2006
CN 101821030 A 9/2010
(Continued)

OTHER PUBLICATIONS

Office Action dated May 25, 2016, issued for the corresponding German Patent Application No. 11 2013 000 097.0 and English translation thereof.

(Continued)

*Primary Examiner* — Robert R Raevis
(74) *Attorney, Agent, or Firm* — Locke Lord LLP

(57) ABSTRACT

The present invention includes a stroke sensor which is arranged on a hydraulic cylinder and measures a stroke length of the hydraulic cylinder; a rotary encoder and a magnetic force sensor which measure a reset reference point to reset a value of the stroke length measured by the stroke sensor; a stroke end detection processing unit which detects a stroke end position of the hydraulic cylinder; a calibration processing unit which calibrates the measured value of the stroke length when the reset reference point and/or the stroke end position is detected; an HMI monitor which displays an entire work machine mounted with the hydraulic cylinder when an initial calibration work for the hydraulic cylinder is carried out; and a highlight display processing unit that highlights a moving portion to drive a hydraulic cylinder to be calibrated along with an indication of a driving direction.

5 Claims, 20 Drawing Sheets

(51) Int. Cl.
*F15B 15/28* (2006.01)
*F15B 19/00* (2006.01)

(56) References Cited

FOREIGN PATENT DOCUMENTS

| | | | |
|---|---|---|---|
| CN | 201889336 | U | 7/2011 |
| DE | 112011100048 | T5 | 6/2012 |
| JP | 2004-132137 | A | 4/2004 |
| JP | 2005-326302 | A | 11/2005 |
| JP | 2006-258730 | A | 9/2006 |
| JP | 2007-333628 | A | 12/2007 |
| JP | 2008-163594 | A | 7/2008 |
| JP | 2010-174980 | A | 8/2010 |

OTHER PUBLICATIONS

International Search Report dated May 14, 2013, issued for PCT/JP2013/061120.
Ke Li et al., "Electro-hydraulic proportional control of twin-cylinder hydraulic elevators," Control Engineering Practice 9, 2001, pp. 367-373.

MENU

Machine Setup

MS Cylinder Calibration

Move BUCKET slowly to dig and wait until the cylinder reaches its control point --- the system will provide feedback with sound.

Status

Bucket : DIG
Arm : READY
Boom : READY

Step

> 2 > > > >

Back

MENU

Machine Setup

MS Cylinder Calibration

Keep ARM dump and wait until the cylinder reaches its stroke end --- the system will provide feedback with sound.

Status

Bucket : OK
Arm : DUMP
Boom : READY

Step

> > 3 > > >

Back

MENU

Machine Setup

MS Cylinder Calibration

Move arm slowly to dig and wait until the cylinder reaches its control point --- the system will provide feedback with sound.

Status

Bucket : OK
Arm : DIG
Boom : READY

Step

> > > 4 > >

Back

MENU

Machine Setup

MS Cylinder Calibration

Keep Boom up and wait until the cylinder reaches its stroke end --- the system will provide feedback with sound.

Status

Bucket : OK
Arm : OK
Boom : UP

Step

> > > > 5 >

Back

APPARATUS AND METHOD FOR ASSISTING HYDRAULIC CYLINDER STROKE INITIAL CALIBRATION WORK

FIELD

The present invention relates to an apparatus and a method for assisting a hydraulic cylinder stroke initial calibration work.

BACKGROUND

An excavator, one of work machines, includes a traveling body, an upper swing body capable of swinging on the traveling body, and work equipment, above the upper swing body. The work equipment includes a boom having one end pivotably supported on a base body, an arm having one end pivotably supported at the other end of the boom, and an attachment pivotably supported at the other end of the arm. The boom, the arm, and the attachment are driven by hydraulic cylinders. A stroke of the hydraulic cylinder is measured to detect the position/posture of this work equipment.

For example, Patent Literature 1 discloses an excavator including a position sensor which detects, by rotation of a rotary roller on a cylinder rod, a piston stroke position of the hydraulic cylinder which drives the work equipment. Since minute slippage occurs between this rotary roller and the cylinder rod, an error may be generated between an actual stroke position and the stroke position obtained from a detection result of the position sensor. Therefore, a magnetic force sensor is provided, as a reset sensor, at a reference position on an outer surface of a cylinder tube of the hydraulic cylinder in order to calibrate the stroke position obtained from the detection result of the position sensor at the reference position. The stroke position detected by the position sensor is calibrated every time the piston passes the reference position while operating, thereby achieving accurate position measurement.

CITATION LIST

Patent Literature

Patent Literature 1: Japanese Patent Application Laid-open No. 2006-258730

Patent Literature 2: Japanese Patent Application Laid-open No. 2007-333628

SUMMARY

Technical Problem

Meanwhile, the above-described hydraulic cylinder includes the stroke sensor (position sensor), and the reset sensor to calibrate a measurement error of the stroke sensor so as to precisely obtain a stroke length of the hydraulic cylinder. Here, to calibrate this measurement error, it is necessary to carry out an initial calibration work in which a latest calibration reference position of the reset sensor is obtained, and stored.

However, this initial calibration work has been carried out with professional skills, in which a service man operates the work equipment in accordance with a prescribed procedure based on his/her own knowledge or some instruction manual. Accordingly, the service man had so many burdens to carry out the initial calibration work in the prior technique, and there was a problem in that it took a long time for an inexperienced service man to complete the initial calibration work due to failure and the like, Meanwhile, Patent Literature 2 discloses a technique of displaying, on a monitor screen, changes of a cylinder stroke position which corresponds to a detent release position of detent function by which the work equipment operation lever is held at a predetermined operating stroke position.

The present invention has been achieved in consideration of the above-described circumstances. An object of the present invention is to provide an apparatus and a method for assisting the hydraulic cylinder stroke initial calibration work, whereby assistance for the hydraulic cylinder stroke initial calibration work may be easily carried out.

Solution to Problem

To overcome the problems and achieve the object, according to the present invention, an apparatus for assisting a hydraulic cylinder stroke initial calibration work, comprises: moving portions rotatably supported in series with respect to a vehicle body; a hydraulic cylinder configured to rotatably support the moving portion and arranged between the vehicle body and the moving portion, or between the moving portions; a stroke sensor mounted on the hydraulic cylinder and configured to measure a stroke length of the hydraulic cylinder; a reset sensor configured to measure a reset reference point to reset a value of the stroke length measured by the stroke sensor; a stroke end detection processing unit configured to detect a stroke end position of the hydraulic cylinder; a calibration processing unit configured to calibrate the measured value of the stroke length when the reset reference point and/or the stroke end position is detected; a monitor configured to display an entire work machine mounted with the hydraulic cylinder when an initial calibration work for the hydraulic cylinder is carried out; and a highlight display processing unit configured to highlight the mowing portion to drive a hydraulic cylinder to be calibrated along with an indication of a driving direction.

According to the present invention, completion of the calibration is displayed when calibration of a hydraulic cylinder to be configured is completed.

According to the present invention, the monitor issues a warning to call attention when an initial calibration work for a hydraulic cylinder is not completed.

According to the present invention, a method for assisting a hydraulic cylinder stroke initial calibration work, wherein when measuring a stroke length of the hydraulic cylinder by a stroke sensor mounted on the hydraulic cylinder, the initial calibration work to calibrate the stroke length is assisted by detecting a reset reference point by a reset sensor and/or a stroke end position of the hydraulic cylinder, and when the hydraulic cylinder initial calibration work is carried out, an entire work machine mounted with the hydraulic cylinder is displayed, and a moving portion to drive a hydraulic cylinder to be calibrated is highlighted along with an indication of a driving direction, and when the calibration of the hydraulic cylinder to be calibrated is completed, completion of the calibration is displayed.

According to the present invention, a warning to call attention is issued when an initial calibration work for a hydraulic cylinder is not completed.

According to the present invention, when the hydraulic cylinder initial calibration work is executed, the monitor is configured to display the entire work machine mounted with the hydraulic cylinder, and to highlight the moving portion to drive the hydraulic cylinder to be calibrated along with the indication of the driving direction. Therefore, the hydraulic cylinder stroke initial calibration work may be simply and easily assisted.

BRIEF DESCRIPTION OF DRAWINGS

FIG. 14-1 is a view illustrating an example of the screen for assisting the stroke initial calibration work according to the second embodiment, displayed on the display unit of the HMI monitor.

FIG. 14-2 is a view illustrating an example of the screen for assisting the stroke calibration work according to the second embodiment, displayed on the display unit of the HMI monitor.

FIG. 14-3 is a view illustrating an example of the screen for assisting the stroke initial calibration work according to the second embodiment, displayed on the display unit of the HMI monitor.

FIG. 14-4 is a view illustrating an example of the screen for assisting the stroke initial calibration work according to the second embodiment, displayed on the display unit of the HMI monitor.

FIG. 14-5 is a view illustrating an example of the screen for assisting the stroke initial calibration work according to the second embodiment, displayed on the display unit of the HMI monitor.

FIG. 14-6 is a view illustrating an example of the screen for assisting the stroke initial calibration work according to the second embodiment, displayed on the display unit of the HMI monitor.

FIG. 14-7 is a view illustrating an example of the screen for assisting the stroke initial calibration work according to the second embodiment, displayed on the display unit of the HMI monitor.

FIG. 14-8 is a view illustrating an example of the screen for assisting the stroke initial calibration work according to the second embodiment, displayed on the display unit of the HMI monitor.

FIG. 14-9 is a view illustrating an example of the screen for assisting the stroke initial calibration work according to the second embodiment, displayed on the display unit of the HMI monitor.

FIG. 14-10 is a view illustrating an example of the screen for assisting the stroke initial calibration work according to the second embodiment, displayed on the display unit of the HMI monitor.

DESCRIPTION OF EMBODIMENTS

Hereinafter, embodiments of the present invention will be described with reference to the attached drawings. First, embodiments of the present invention will be described. In the following, a description will be given for an excavator, an example of the work machines, to which an idea of the present invention may be applied.

First Embodiment

[Entire Structure of Excavator]

Figure 1:
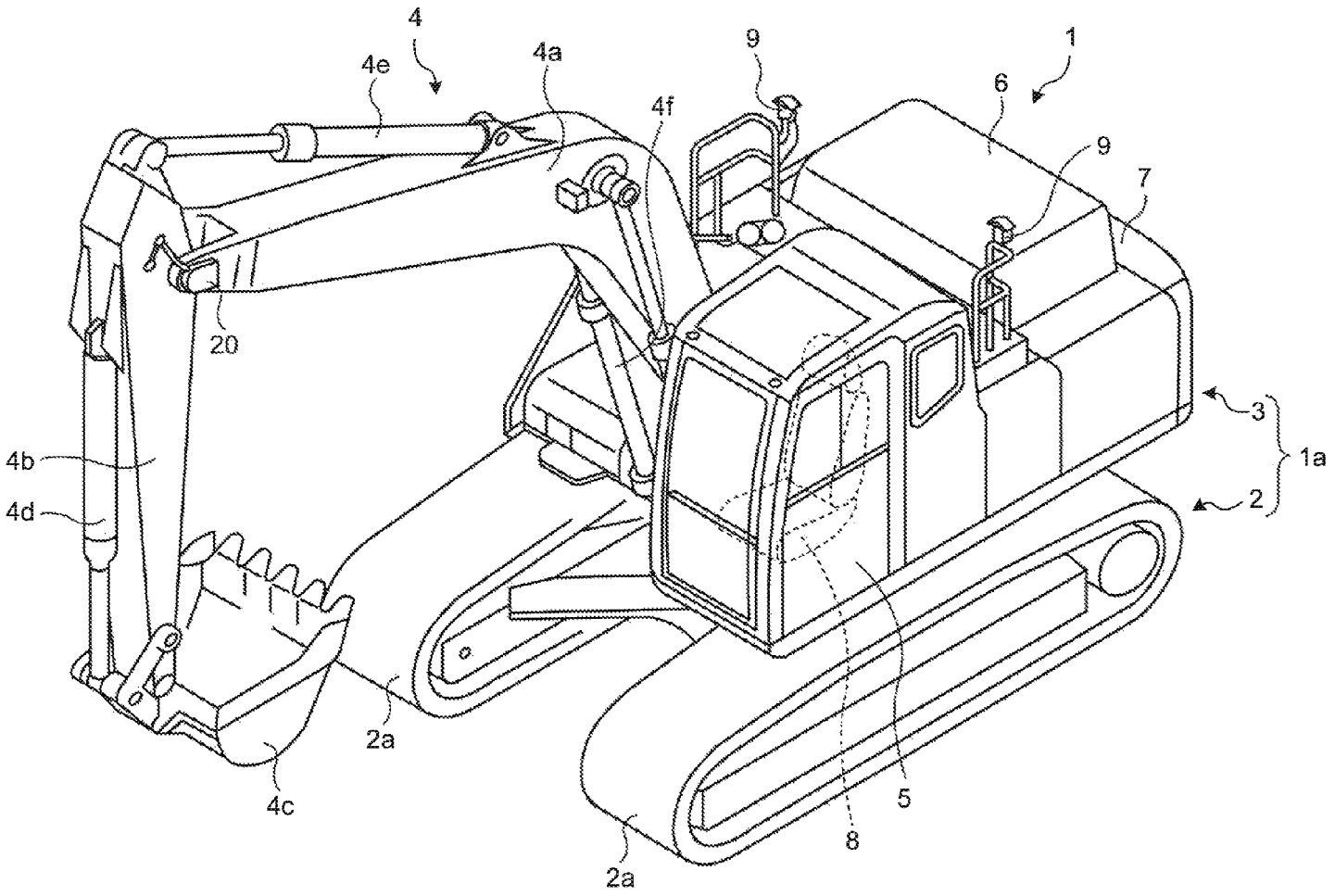
FIG. 1 is a perspective view illustrating an entire structure of an excavator, as an example of work machines, in which hydraulic cylinders according to an embodiment of the present invention are applied.

As illustrated in FIG. 1, an excavator 1 includes a lower traveling body 2, an upper swing body 3, and work equipment 4. The lower traveling body 2 is configured to automatically travel as a pair of right and left crawlers 2*a* rotate. The upper swing body 3 is swingably mounted on the lower traveling body 2. The work equipment 4 is pivotably supported at the front side of the upper swing body 3 so as to freely move up and down. This work equipment 4 includes a boom 4*a*, an arm 4*b*, a bucket 4*c* as an example of attachments, and hydraulic cylinders (a bucket cylinder 4*d*, an arm cylinder 4*e*, and a boom cylinder 4*f*).

A vehicle body 1*a* is mainly formed of the lower traveling body 2 and the upper swing body 3. The upper swing body 3 includes a cab 5 on the front left side (vehicle front side), and includes, on the rear side (vehicle rear side), an engine room 6 for housing an engine, and a counterweight 7. Inside the cab 5, a driver's seat 8 is placed for an operator to be seated. Further, a plurality of antennas 9 is set on both right and left sides of a rear upper surface of the upper swing body 3. Meanwhile, according to this first embodiment, note that front, back, right and left of the vehicle are determined based on the operator who is seated on the driver's seat 8 placed inside the cab 5.

The boom 4*a*, the arm 4*b*, and the bucket 4*c* are rotatably supported in series with respect to the vehicle body 1*a*. The boom 4*a*, the arm 4*b*, and the bucket 4*c* are moving portions of the vehicle body 1*a*, the boom 4*a*, and the arm 4*b* respectively.

A rotary encoder 20 is mounted on the boom 4*a*. As described later, the rotary encoder 20 is also mounted on the vehicle body. Rotation of the arm 4*b* with respect to the boom 4*a* is transmitted to the rotary encoder 20 mounted on the boom 4*a* via a lever pivotably supported at the arm 4*b*. The rotary encoder 20 outputs a pulse signal corresponding to a rotation angle of the arm 4*b*. Rotation of the boom 4*a* with respect to the vehicle body 1*a* is transmitted to the rotary encoder 20 mounted on the vehicle body 1*a* via the lever pivotably supported at the boom 4*a*. The rotary encoder 20 outputs a pulse signal corresponding to a rotation angle of the boom 4*a*.

[Circuit Configuration of Excavator]

Figure 2:
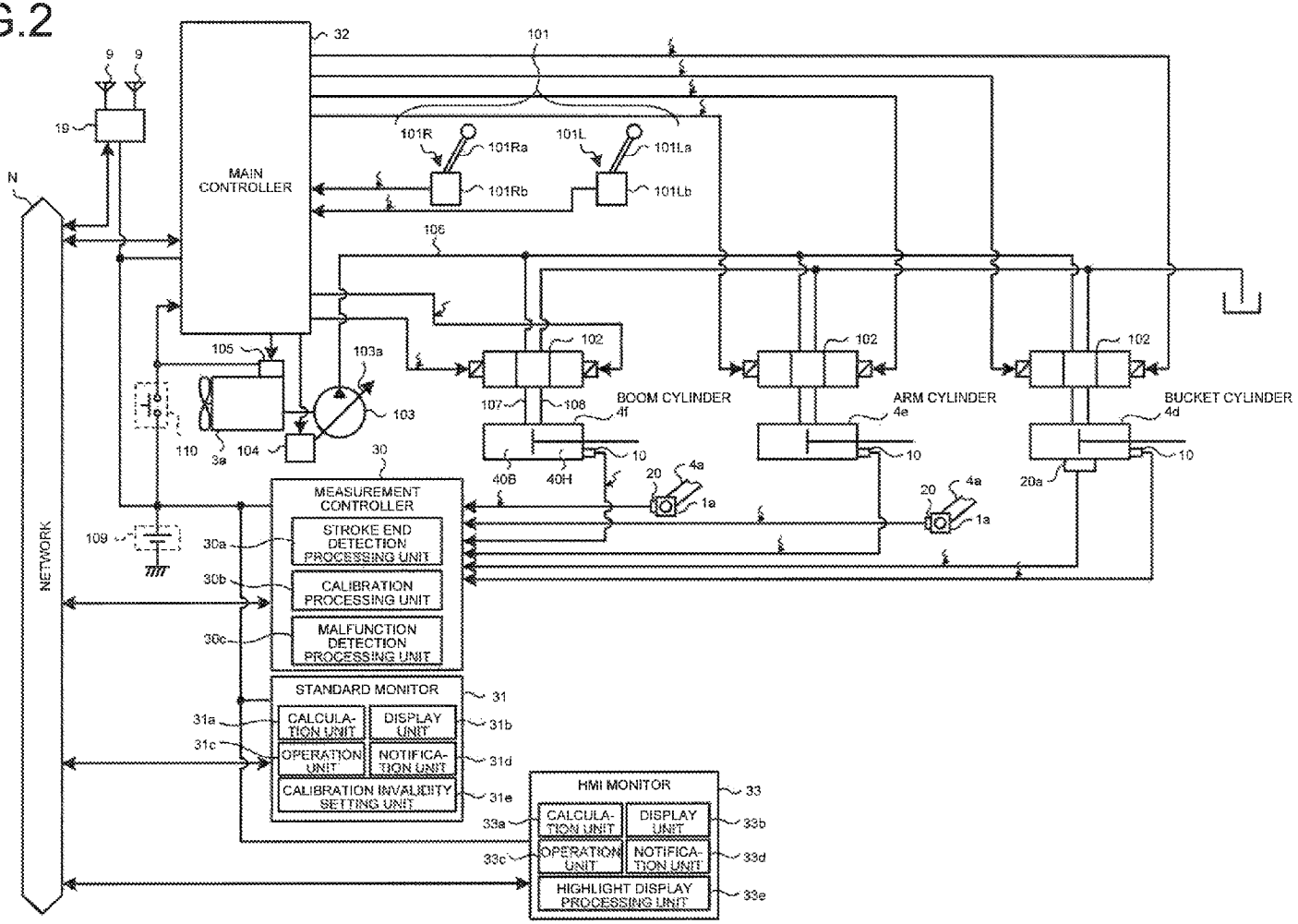
FIG. 2 is a block diagram illustrating an entire circuit configuration of the excavator, illustrated in FIG. 1, which includes an apparatus for assisting the hydraulic cylinder stroke operation diagnosis.

A description will be given for a hydraulic circuit of the excavator 1 with reference to FIGS. 1 and 2. FIG. 2 is a block diagram illustrating an entire circuit configuration of the excavator, illustrated in FIG. 1, which includes an apparatus for assisting the hydraulic cylinder stroke operation diagnosis. In the following, a description will be given, focusing on the boom cylinder among the hydraulic cylinders. Meanwhile, note that the similar operation diagnosis is also carried out for the arm cylinder 4*e* and the bucket cylinder 4*d* besides the boom cylinder 4*f*, although no description will be given therefor. In FIG. 2, an electric signal is input from an electric type operation lever device 101 to a main controller 32. Then, the boom cylinder 4*f* is driven by a control electric signal supplied from the main controller 32 to a control valve 102 of the boom cylinder 4*f*.

As illustrated in FIG. 1, the work equipment 4 includes the boom 4*a*, the arm 4*b*, and the bucket 4*c*. The boom 4*a*, the arm 4*b*, and the bucket 4*c* are respectively operated by driving the corresponding boom cylinder 4*f*, arm cylinder 4*e*, and bucket cylinder 4*d*.

The boom cylinder 4*f* is driven, for example, by a variable displacement hydraulic pump 103 as a drive source. The hydraulic pump 103 is driven by an engine 3*a*. A swash plate 103*a* of the hydraulic pump 103 is driven by a servo mechanism 104. The servo mechanism 104 operates in accordance with a control signal (electric signal) output from the main controller 32, and the position of the swash plate 103*a* of the hydraulic pump 103 is changed in accordance with the control signal. Also, an engine driving mechanism 105 of the engine 3*a* operates in accordance with a control signal (electric signal) output from the main controller 32, and the engine 3*a* runs at an engine speed according to the control signal.

A discharge port of the hydraulic pump 103 is in communication with the control valve 102 via a discharge oil passage 106. The control valve 102 is in communication with a cap-side oil chamber 40B and a rod-side oil chamber 40H of the boom cylinder 4*f* via oil passages 107 and 108. The hydraulic oil discharged from the hydraulic pump 103 is supplied to the control valve 102 via the discharge oil passage 106. The hydraulic oil having passed the control valve 102 is supplied to the cap-side oil chamber 40B or the rod-side oil chamber 40H of the boom cylinder 4*f* via the oil passage 107 or the oil passage 108.

A stroke sensor 10 is mounted on the boom cylinder 4*f*. The stroke sensor 10 measures a piston stroke. The rotary encoder 20 that functions as a reset sensor is mounted on a portion where one end of the boom 4*a* of the vehicle body 1*a* is pivotably supported. The rotary encoder 20 detects a rotation angle of the boom 4*a*, and outputs a pulse signal according to the rotation angle. The stroke sensor 10 and the rotary encoder 20 are each connected to a measurement controller 30.

A battery 109 is a power source which activates the main controller 32. The measurement controller 30, a standard monitor 31, and an HMI (Human Machine Interface) monitor 33 as an information-oriented construction guidance monitor are electrically connected to the battery 109. The main controller 32 is electrically connected to the battery 109 via an engine key switch 110.

When the engine key switch 110 is turned on, the battery 109 is electrically connected to a start-up motor (not illustrated) of the engine 3*a* to start the engine 3*a*, and also the battery 109 is electrically connected to the main controller 32 to activate the main controller 32. When the engine key switch 110 is turned off, the electrical connection between the main controller 32 and the battery 109 is cut off, the engine 3*a* is stopped, and further the activated main controller 32 is stopped.

The main controller 32, the measurement controller 30, the standard monitor 31, the HMI monitor 33, and a position information detector 19 are mutually connected via a network N inside the vehicle. A switch state signal indicating the switch state (ON/OFF) of the engine key switch 110 is input from the main controller 32 to the measurement controller 30, the standard monitor 31, and the HMI monitor 33 via the network N. In the case where the switch state signal input to the measurement controller 30, the standard monitor 31, and the HMI monitor 33 is ON, the measurement controller 30, the standard monitor 31, and the HMI monitor 33 are activated. In the case where the switch state signal turns to OFF, the measurement controller 30, the standard monitor 31, and the HMI monitor 33 are inactivated.

Operation lever devices 101R and 101L include, for example, operation levers 101Ra and 101La each provided inside the cab 5, and detectors 101Rb and 101Lb. The detectors 101Rb and 101Lb detect operation signals indicating operating directions and operating amounts of the operation levers 101Ra and 101La. The operation signals detected by the detectors 101Rb and 101Lb are input to the main controller 32. The control valve 102 is connected to the main controller 32 via the electric signal line. Here, the operation lever devices 101R and 101L, are a pair of right and left levers. The operation lever device 101R is adapted to operate the boom 4*a* and the bucket 4*c*, and the operation lever device 101L is adapted to operate the arm 4*b* and to swing the upper swing body 3. Note that a swing actuator of the upper swing body 3 is not illustrated.

Here, for example, when the operation lever 101Ra is operated, an operation signal of the operation lever 101Ra is input to the main controller 32, and a control signal to operate the control valve 102 is generated at the main controller 32. This control signal is supplied to the control valve 102 from the main controller 32 via the electric signal line, and the position of the control valve 102 is changed.

[Configuration of Apparatus for Assisting Hydraulic Cylinder Stroke Operation Diagnosis]

Next, a description will be given for an apparatus that assists the hydraulic cylinder stroke operation diagnosis. This apparatus for assisting the hydraulic cylinder stroke operation diagnosis includes the hydraulic cylinders (bucket cylinder 4*d*, arm cylinder 4*e*, boom cylinder 4*f*), the measurement controller 30, the standard monitor 31, the HMI monitor 33, and the main controller 32.

The stroke sensor 10, which detects a stroke amount of the hydraulic cylinder as a rotation amount, is mounted on each of the arm cylinder 4*e* and the boom cylinder 4*f*. Further, the stroke sensor 10 and a magnetic force sensor 20*a* are mounted on the bucket cylinder 4*d*.

The rotary encoders 20 are mounted on portions supporting rotary shafts of the arm 4*b* and the boom 4*a*. The rotary encoder 20 outputs pulse signals in accordance with rotation amounts (angles) of the arm 4*b* and the boom 4*a*. This pulse signal is a square-wave signal.

The stroke sensor 10, the rotary encoder 20, and the magnetic force sensor 20*a* are electrically connected to the measurement controller 30. The measurement controller 30 includes a calibration processing unit 30*b*. The calibration processing unit 30*b* calibrates stroke lengths measured by the respective stroke sensors 10 of the bucket cylinder 4*d*, the are cylinder 4*e*, and the boom cylinder 4*f*, based on the detection signals of the stroke sensor 10, the rotary encoder 20, and the magnetic force sensor 20*a*. In other words, the stroke lengths measured by the stroke sensors 10 of the bucket cylinder 4*d* and the arm cylinder 4*e* are calibrated respectively based on the measurement results of the corresponding rotary encoders 20. Further, the stroke length measured by the stroke sensor 10 of the bucket cylinder 4*d* is calibrated based on the measurement result of the magnetic force sensor 20*a* that functions as a reset sensor. Meanwhile, the measurement controller 30 computes the position and posture of the bucket 4*c* based on the measured stroke lengths of the respective hydraulic cylinders.

Additionally, the measurement controller 30 includes a stroke end detection processing unit 30*a*. The stroke end detection processing unit 30*a* detects whether the piston has reached a stroke end, namely, a maximum stroke position or a minimum stroke position. This stroke end detection processing unit 30*a* determines that the piston has reached the stroke end when the following three conditions are fulfilled: the operation levers 101Ra and 101La are being operated; the stroke position measured by the stroke sensor 10 is, for example, within 3 mm from the stroke end position; and a moving velocity of the piston is minute, such as ±3 mm/sec or less. Note that the moving velocity of the piston is obtained by differentiating the stroke position detected by the stroke sensor 10 by time. Further, whether the piston has reached the stroke end may be also determined by a following condition: an acquired discharge pressure of the hydraulic pump 103 exceeds a predetermined pressure, which is a relief state. Additionally, the calibration processing unit 30*b* is configured to reset the stroke length in the case where the piston has reached the stroke end as well as in the case where the stroke length is reset by the above-described rotary encoder 20 and the magnetic force sensor 20*a* which are the reset sensors.

Moreover, the measurement controller 30 includes a malfunction detection processing unit 30*c*. The malfunction detection processing unit 30*c* outputs an error indicating a stroke malfunction in the case where a measured stroke length exceeds a predetermined value which is larger than a stroke range defined by the minimum stroke end position and the maximum stroke end position.

The standard monitor 31 includes a calculation unit 31*a*, a display unit 31*b*, an operation unit 31*c*, a notification unit 31*d*, and a calibration invalidity setting unit 31*e*. The calculation unit 31*a* acquires various information by communicating with the main controller 32 and the measurement controller 30, and displays the acquired various information on a display screen of the display unit 31*b*. Further, the calculation unit 31*a* outputs various instruction information received from the operation unit 31*c* to the display unit 31*b*, other controllers, etc. Additionally, the notification unit 31*d* is formed of, for example, a buzzer, and outputs a sound and the like in the case where a warning such as an error warning is necessary. The calibration invalidity setting unit 31*e* sets validity/invalidity of the reset processing executed by the reset sensor which will be described later. The display unit 31*b* may be a touch panel used also as the operation unit 31*c*.

The HMI monitor 33 includes a calculation unit 33*a*, a display unit 33*b*, an operation unit 33*c*, a notification unit 33*d*, and a highlight display processing unit 33*e*. The calculation unit 33*a* acquires various information by communicating with the main controller 32 and the measurement controller 30, and displays the acquired various information on a display screen of the display unit 33*b*. Further, the calculation unit 33*a* outputs various instruction information received from the operation unit 33*c* to the display unit 33*b*, other controllers, etc. Additionally, the notification unit 33*d* is formed of, for example, a buzzer, and outputs a sound and the like in the case where a warning such as an error warning is necessary. Meanwhile, the display unit 33*b* of the HMI monitor 33 is formed of a touch panel that is also used as the operation unit 33*c*, but the display unit 33*b* and the operation unit 33*c* may be also formed separately. Further, the HMI monitor 33 assists the initial calibration work by changing the screen for assisting the stroke initial work which, will be described later. Meanwhile, the position information detector 19 computes the position and orientation of the excavator 1 based on position information acquired via the antennas 9, and transmits a computing result to the main controller 32 and the HMI monitor 33, thereby achieving information-oriented construction processing.

[Arrangement and Operation of Stroke Sensor]

Next, a description will be given for the stroke sensor 10 with reference to FIGS. 3 and 4. Here, for convenience of explanation, a description will be given for the stroke sensor 10 mounted on the boom cylinder 4*f*. However, the similar stroke sensor 10 is also attached to the arm cylinder 4*e*.

Figure 3:
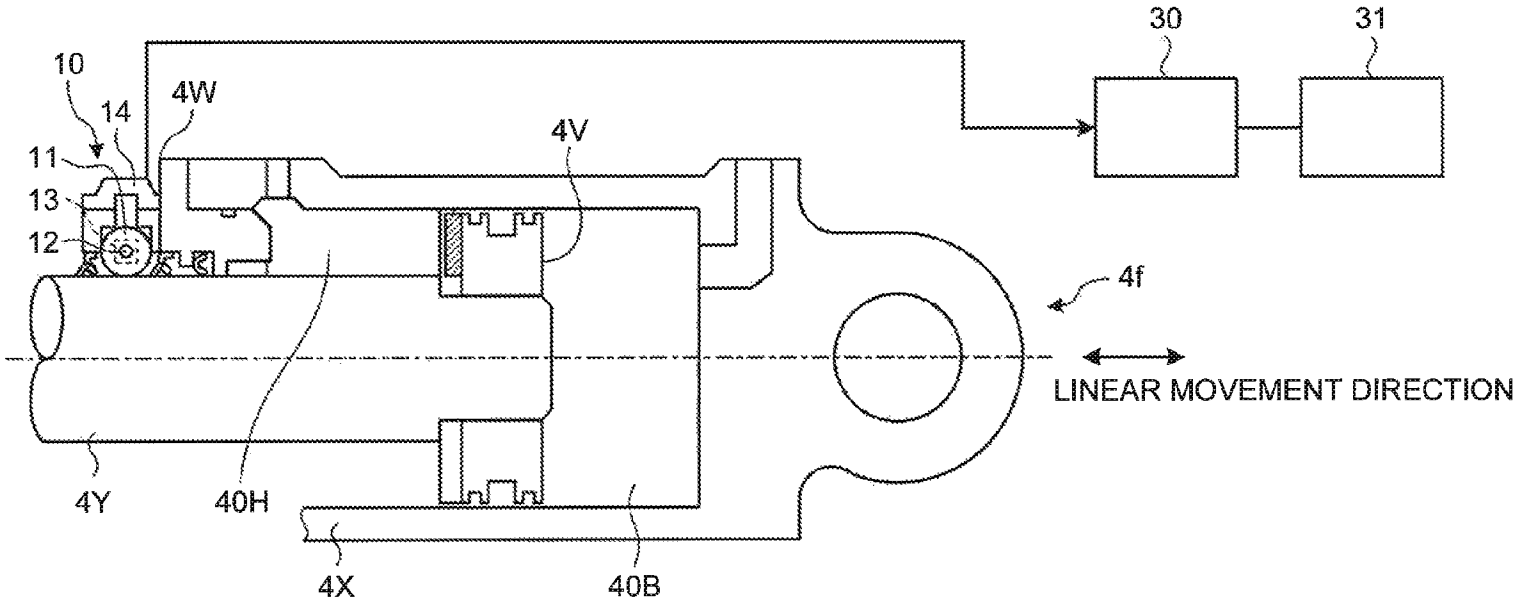
FIG. 3 is a schematic diagram illustrating an arrangement structure of a stroke sensor with respect to the hydraulic cylinder.

As illustrated in FIG. 3, the boom cylinder 4*f* includes a cylinder tube 4X, and a cylinder rod 4Y movable inside the cylinder tube 4X relative to the cylinder tube 4X. A piston 4V is slidably mounted on the cylinder tube 4X. The cylinder rod 4Y is attached to the piston 4V. The cylinder rod 4Y is slidably mounted on a cylinder head 4W. A chamber defined by the cylinder head 4W, the piston 4V, and a cylinder inner wall is a rod-side oil chamber 40H. The oil chamber located on the opposite side of the rod-side oil chamber 40H via the piston 4V is a cap-side oil chamber 40B. Additionally, the cylinder head 4W is provided with a seal member so as to seal a clearance between the cylinder rod 4Y and the cylinder head 4W and avoid entry of dust and the like into the rod-side oil chamber 40H.

The cylinder rod 4Y contracts as the hydraulic oil is supplied to the rod-side oil chamber 40H and discharged from the cap-side oil chamber 403. Also, the cylinder rod 4Y extends as the hydraulic oil is discharged from the rod-side of chamber 40H and supplied to the cap-side oil chamber 40B. In other words, the cylinder rod 4Y linearly moves in the horizontal direction in the drawing.

A case 14, which covers the stroke sensor 10 and houses the stroke sensor 10 inside thereof, is provided outside the rod-side oil chamber 40H and adjacent to the cylinder head 4W. The case 14 is fastened to the cylinder head 4W, for example, with a bolt, and fixed to the cylinder head 4W.

The stroke sensor 10 includes a rotary roller 11, a rotary central shaft 12, and a rotation sensing portion 13. A surface of the rotary roller 11 contacts a surface of the cylinder rod 4Y, and is arranged so as to freely rotate in accordance with the linear movement of the cylinder rod 4Y. In other words, the linear movement of the cylinder rod 4Y is converted to the rotary movement by the rotary roller 11. The rotary central shaft 12 is arranged so as to be orthogonal to the direction of the linear movement of the cylinder rod 4Y.

The rotation sensing portion 13 is configured to detect a rotation amount (rotation angle) of the rotary roller 11 as an electric signal. The signal indicating the rotation amount (rotation angle) of the rotary roller 11 detected by the rotation sensing portion 13 is transmitted to the measurement controller 30 via the electric signal line, and is converted to a position (stroke position) of the cylinder rod 4Y of the boom cylinder 4*f* at the measurement controller 30.

Figure 4:
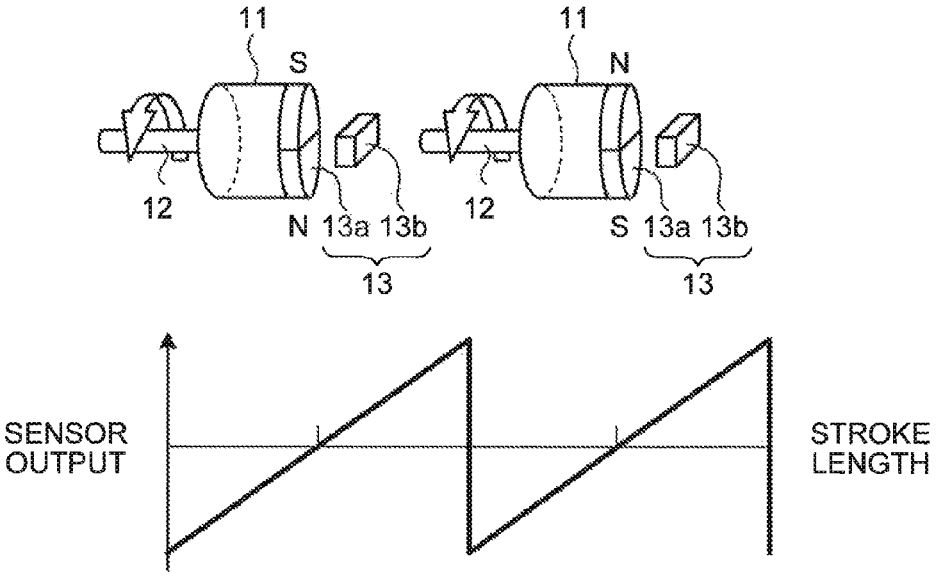
FIG. 4 is a schematic diagram illustrating an outline structure of the stroke sensor and the operation thereof.

As illustrated in FIG. 4, the rotation sensing portion 13 includes a magnet 13*a* and a Hall IC 13*b*. The magnet 13*a*, which is a detecting medium, is attached to the rotary roller 11 so as to rotate integrally with the rotary roller 11. The magnet 13*a* rotates in accordance with the rotation of the rotary roller 11 around the rotary central shaft 12. The magnet 13*a* is configured to alternately switch between the north pole and the south pole in accordance with the rotation angle of the rotary roller 11. The magnet 13*a* is configured to periodically fluctuate magnetic force (magnetic flux density) detected at the Hall IC 13*b*, provided that one period corresponds to one rotation of the rotary roller 11.

The Hall IC 13*b* is a magnetic force sensor that detects the magnetic force (magnetic flux density) generated by the magnet 13*a* as an electric signal. The Hall IC 13*b* is arranged at a position distant from the magnet 13*a* by a predetermined distance along the axial direction of the rotary central shaft 12.

The electric signal detected by the Hall IC 13*b* is transmitted to the measurement controller 30, and the electric signal from the Hall IC 13*b* is converted, at the measurement controller 30, to the rotation amount of the rotary roller 11, namely a displacement amount (stroke length) of the cylinder rod 4Y of the boom cylinder 4*f*. More specifically, the displacement amount of the linear movement of the cylinder rod 4Y when the rotary roller 11 makes one rotation is calculated as 2nd, using a rotation radius d of the rotary roller 11.

Here, a relation between the rotation angle of the rotary roller 11 and the electric signal (voltage) detected at the Hall IC 13*b* is described with reference to FIG. 4. When the rotary roller 11 rotates and the magnet 13*a* rotates in accordance with the rotation of the rotary roller 11, the magnetic force (magnetic flux density) which passes the Hall IC 13*b* periodically changes in accordance with the rotation angle, and the electric signal (voltage), which is a sensor output, periodically changes. The rotation angle of the rotary roller 11 may be measured from a voltage level output from this Hall IC 13*b*.

Further, the number of rotations of the rotary roller 11 may be measured by counting the repeated number of a cycle of the electric signal (voltage) output from the Hall IC 13*b*. Then, the displacement amount (stroke length) of the cylinder rod 4Y of the boom cylinder 4*f* is measured based on the rotation angle of the rotary roller 11 and the number of rotations of the rotary roller 11.

[Rotary Encoder Operation]

Figure 5:
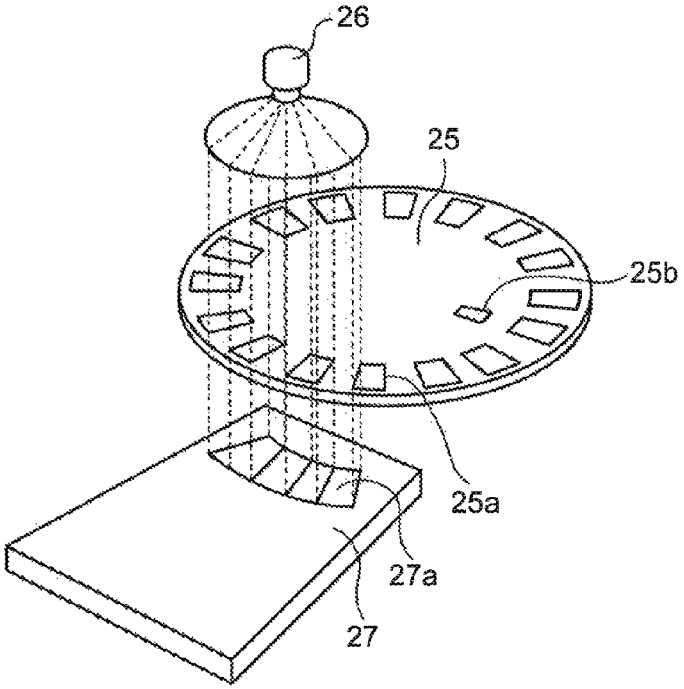
FIG. 5 is a schematic diagram illustrating an outline structure of a rotary encoder which is a reset sensor.

As illustrated in FIG. 5, the rotary encoder 20 includes a disc portion 25, a light emitting portion 26, and a light receiving portion 27. The light emitting portion 26 and the light receiving portion 27 are arranged with the disc portion 25 interposed therebetween. The light emitting portion 26 includes a light emitting element that emits light to the light receiving portion 27. The light receiving portion 27 includes four light receiving elements 27*a* capable of receiving the light emitted from the light emitting portion 26. The four light receiving elements 27*a* have the same width W, and are continuously arranged in series in an arc-form. The light receiving element 27*a* converts the amount of the received light to an electric signal. A plurality of first light transmitting portions 25*a*, which transmits the emitted light from the light emitting portion 26 to the light receiving portion 27, is arranged on the disc portion 25. The first light transmitting portion 25*a* is a substantially rectangular slit which radially extends and has a width 2W in a circumferential direction. The first light transmitting portions 25*a* are circularly arranged at intervals of 2W in the vicinity of and in parallel to an outer periphery of the disc portion 25. A single light transmitting portion 25*b* is arranged inside the circle formed of the first light transmitting portions 25*a*. The light transmitting portion 25*b* is a substantially rectangular slit which radially extends.

The disc portion 25 rotates in synchronization with the rotation of the boom 4*a* with respect to the vehicle body 1*a*. The four light receiving elements 27*a* respectively output electric signals in accordance with the amounts of light passing through the first light transmitting portions 25*a* and the second light transmitting portion 25*b* by the rotation of the disc portion 25. In accordance with the amounts of light which has passed through the first light transmitting portions 25*a* and the second light transmitting portion 25*b*, the light receiving portion 27 converts, to pulse signals, the electric signals output from the first and third light receiving elements 27*a* mutually spaced apart, and the electric signals output from the second and fourth light receiving elements 27*a* mutually spaced apart, out of the light receiving elements 27*a* continuously arranged in series. Subsequently, the light receiving portion 27 outputs the converted pulse signals to the measurement controller 30. The reason why the electric signals from the two light receiving elements 27*a* are used to generate one pulse signal is to improve robustness of the sensor against the external light, etc.

Also, after the light receiving element 27*a* outputs the electric signal obtained by the light which has passed through the light transmitting portion 25*b*, the light receiving portion 27 outputs a corresponding pulse signal. That is to say, the light receiving portion 27 outputs three pulse signals generated in accordance with the rotation angle of the disc portion 25. The pulse signal is output in accordance with the rotation angle of the boom cylinder 4*f* because the rotation angle of the disc portion 25 is identical to the rotation angle of the boom 4*a*.

More specifically, the rotary encoder 20 is an incremental encoder, and configured to output a pulse signal of an A-phase, a pulse signal of a B-phase that differs from the A-phase by 90 degrees, and a pulse signal (reference pulse signal) of a Z-phase. The pulse signal of the Z-phase is generated when the light passes through the light transmitting portion 25*b* at every rotation of the disc portion 25. The measurement controller 30 counts changes of rise and fall of the pulse signals of the A-phase and the B-phase. A count value is proportional to the rotation amount of the boom cylinder 4*f*. The measurement controller 30 determines a rotation direction of the boom 4*a* based on a phase difference between the A-phase and the B-phase. Further, a reference position of rotation of the boom 4*a* is measured by the pulse signal of the Z-phase, and the count value is cleared. An approximate center of an angle range within which the boom 4*a* may rotate is set as the reference position. The measurement controller 30 monitors a count value of the rotary encoder 20, and stores an arbitrary number of strokes per predetermined count value, and then stores an average value thereof as a reset reference point (intermediate reset position), namely a setting reference position. The pulse signal of the Z-phase is output when the emitted light that has passed through the light transmitting portion 25*a* corresponding to the Z-phase is shielded by the disc portion 25. That is, the pulse signal of the Z-phase is detected when the pulse signal falls.

The rotary encoder 20 outputs the pulse signal of the Z-phase at an angle substantially in the middle of the angle range within which the boom 4*a* may rotate. In other words, the rotary encoder 20 outputs the pulse signal of the Z-phase at an approximate center of a stroke range of the boom cylinder 4*f*. According to the first embodiment, the intermediate reset position of the rotary encoder 20 is as described above, but an arbitrary position except for the stroke end of the hydraulic cylinder may be set as the intermediate reset position.

[Measurement and Calibration of Stroke Length by Measurement Controller]

Figure 6:
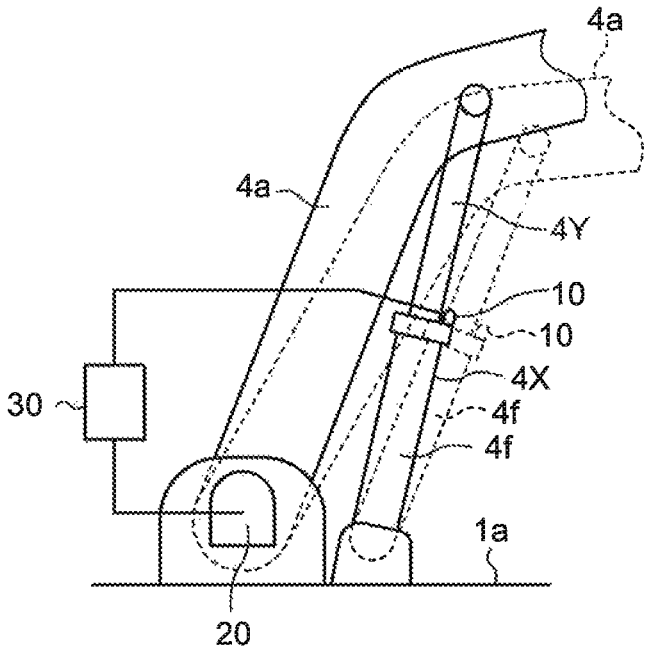
FIG. 6 is a schematic diagram illustrating moving up/down states of a boom of the excavator.

Next, a description will be given for measurement and calibration of a stroke length by the measurement controller 30. Here, the description will be given with an example of measurement and calibration of a stroke length in the case where the boom 4*a* moves up and down. As illustrated in FIG. 6, the boom 4*a* moves up and down as the boom cylinder 4*f* expands and contracts. The boom cylinder 4*f* reaches the expanding-side stroke end when the boom 4*a* moves up to the highest level, and reaches the contracting-side stroke end when the boom 4*a* moves down to the lowest level. The stroke length of the boom cylinder 4*f* in this case is measured based on the rotation amount of the rotary roller 11 at the stroke sensor 10.

Here, it is not possible to avoid minute slippage occurring between the rotary roller 11 at the stroke sensor 10 and the cylinder rod 4Y. Particularly, a large slippage may occur in the event of the piston 4V colliding against the cylinder tube 4X at the stroke end position, or in the event of any impact given to the cylinder rod 4Y during operation. Due to this slippage, an error (accumulated error due to slippage) is generated between an actual position of the cylinder rod 4Y and a stroke measurement position of the cylinder rod 4Y obtained by a detection result of the stroke sensor 10. Accordingly, the rotary encoder 20 is provided, as the reset sensor, to calibrate the stroke measurement value obtained by the detection result of the stroke sensor 10. The rotary roller 11 and the rotary encoder 20 are connected to the measurement controller 30, and the measurement controller 30 calibrates the stroke length measured by the stroke sensor 10 based on the pulse signal output from the rotary encoder 20.

As illustrated in FIG. 6, the boom 4*a* moves up as the boom cylinder 4*f* extends. The stroke length of the boom cylinder 4*f* at this point is measured by the stroke sensor 10. On the other hand, as the boom 4*a* moves up, the disc portion 25 of the rotary encoder 20 rotates as the boom 4*a* rotates with respect to the vehicle body 1*a*. At this point, the light emitted from the light emitting portion 26 and having passed through the light transmitting portions 25*a* and 25*b* of the disc portion 25 is received by the light receiving portion 27. This causes a pulse signal according to the rotation angle of the disc portion 25 to be output from the light receiving portion 27. The pulse signals of the A-phase, the B-phase, and the Z-phase are respectively output from the light receiving portion 27. The pulse signal of the Z-phase is associated with a reference angle, which is a predetermined rotation angle of the boom 4*a*, and is output when the boom 4*a* reaches the reference angle.

Figure 7:
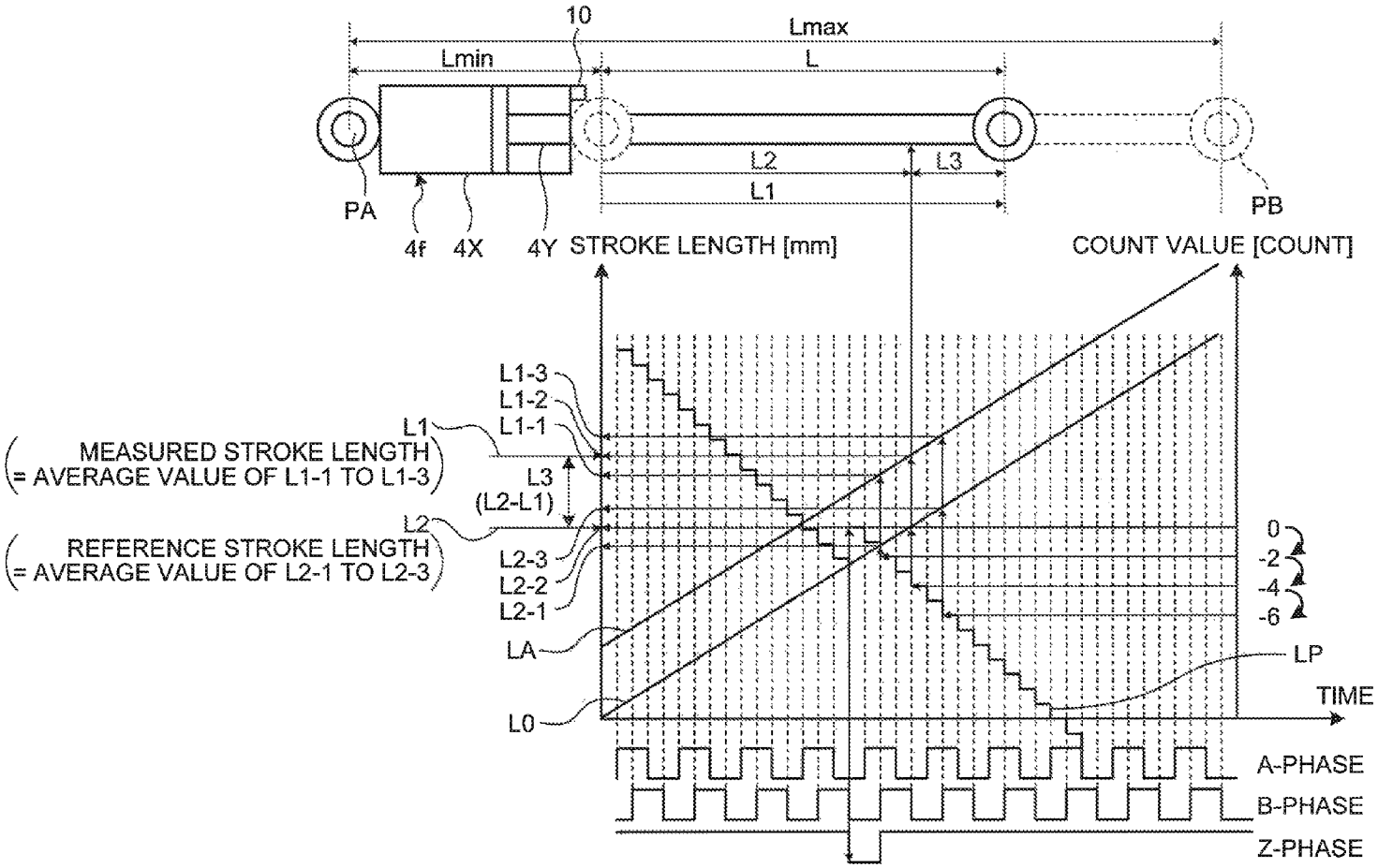
FIG. 7 is a schematic diagram describing a stroke length of the hydraulic cylinder as well as the stroke length calibration processing.

Here, note that a reference stroke length L2 is stored in the measurement controller 30 at the time of initial calibration as illustrated in FIG. 7. The initial calibration herein is to obtain and store the reference stroke length L2 at the time of factory shipment of the excavator 1, or at the time of replacement of the rotary encoder 20 and the magnetic force sensor 20*a* which are the reset sensors. At the time of initial calibration, the measurement controller 30 stores, after detecting a pulse fail of the Z-phase, stroke lengths L2-1 to L2-3 of the boom cylinder 4*f* corresponding to count values of a predetermined integral number of times (here, every multiple of −2, three times) of the rotary encoder 20, and then stores an average value thereof as the reference stroke length L2. Meanwhile, in FIG. 7, L0 indicates changes of the stroke length at the time of the initial calibration, LA indicates changes of the stroke length at the time other than the initial calibration, and LP indicates changes of the count values of the rotary encoder 20.

On the other hand, the measurement controller 30 detects growths of the stroke lengths L1-1 to L1-3 of the boom cylinder 4*f* corresponding to the count values of the predetermined integral number of times (here, every multiple of 2, three times) of the rotary encoder 20 at the time of detecting the pulse signal of the Z-phase in course of the normal operation of the boom cylinder 4*f*. The measurement controller 30 stores the stroke lengths L1-1 to L1-3 measured the predetermined number of times, and then stores an average value thereof as a measured stroke length L1.

As described above, the reference stroke length L2 for the count values of the predetermined integral number of times of the rotary encoder 20, which have been calculated and stored by the initial calibration, is stored in the measurement controller 30. The measurement controller 30 calculates a difference L3 between the measured stroke length L1 detected at the time of the normal operation other than the initial calibration, and the reference stroke length L2 detected at the time of the initial calibration.

Subsequently, the measurement controller 30 calibrates the measured value of the stroke sensor 10, using the difference L3 when the boom cylinder 4*f* stops after the pulse signal of the Z-phase is detected and the measurement is carried out through the normal operation of the boom cylinder 4*f*.

In other words, the measurement controller 30 detects, by the fall of the Z-phase of the rotary encoder 20, that the boom 4*a* has reached a reference rotation angle, and further detects rotation of a predetermined angle from the reference rotation angle, and then stores the stroke lengths of the boom cylinder 4*f* the predetermined number of times during this time, and subsequently stores the average value thereof (measured stroke length L1). Further, the measurement controller compares the measured stroke length L1 with the reference stroke length L2 stored in advance at the time of the initial calibration, and calculates a deviation (difference L3). Then, when the boom 4*a* stops, the measurement controller executes calibration whereby the deviation is incorporated into the measured value.

[Calibration of Magnetic Force Sensor and Calibration of Stroke Length]

The rotary encoder 20 may not be mounted on the bucket cylinder 4*d* because the bucket cylinder 4*d* often comes in contact with water and sediment in comparison with the boom cylinder 4*f* and the arm cylinder 4*e*. For this reason, as for the bucket cylinder 4*d*, the magnetic force sensor 20*a* is mounted on an outer periphery of the cylinder tube 4X as the reset sensor as described above, and calibration is carried out so as to reset the stroke position obtained from the detection result of the stroke sensor 10 to the intermediate reset position (origin position).

Figure 8:
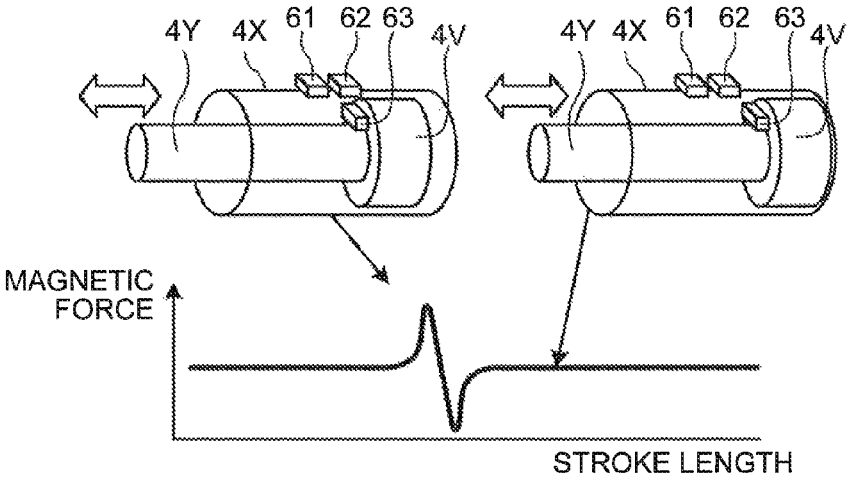
FIG. 8 is a schematic diagram illustrating an outline structure of a magnetic force sensor which is a reset sensor and the operation thereof.

As illustrated in FIG. 8, the magnetic force sensor 20*a* is attached to the outside of the cylinder tube 4X. The magnetic force sensor 20*a* includes two magnetic force sensors 61 and 62 arranged separately with a predetermined distance along the linear movement direction of the piston 4V. The magnetic force sensors 61 and 62 are provided at known intermediate reset positions (origin positions). The piston 4V includes a magnet 63 which generates magnetic force line.

The magnetic force sensors 61 and 62 transmit the magnetic force line generated at the magnet 63, detect magnetic force (magnetic flux density), and output electric signals (voltages) corresponding to the magnetic force (magnetic flux density). The signals detected at the magnetic force sensors 61 and 62 are transmitted to the measurement controller 30. This measurement controller 30 carries out calibration so as to reset the stroke position obtained from the detection result of the stroke sensor 10 to the intermediate reset position (origin position) based on the changes of the detection results of the magnetic force sensors 61 and 62. The calibration contents are the same as the calibration by the rotary encoder 20.

[Control of Calibration Inhibition Processing at the Time of Starting Power Supply to Device]

Meanwhile, in the case where the work equipment is not in a stable posture under the state of power supply loss in the device in which no stroke length is detected (a state in which no power is supplied to the main controller 30), the stroke length may change due to the dead weight of the work equipment itself. In this case, a deviation occurs between an actual stroke length of the hydraulic cylinder and the stroke length measured immediately after the power supply loss in the device. Here, in the case where there is any deviation between the actual stroke length and the latest measured stroke length at the time of starting power supply to device, the malfunction detection processing unit 30*c* issues an error warning, for example, with a buzzer, thereby interfering with progress of the work equipment operation.

For this reason, at the time of starting power supply to the device, the measurement controller 30 executes control whereby calibration processing for the stroke length is inhibited until the cylinder rod passes the intermediate reset position of the reset sensor and the reset is executed. In other words, the deviation between the actual stroke length and the latest measured stroke length is allowed until the cylinder rod passes the intermediate reset position of the reset sensor so that no error warning may be issued.

Now, a description will be given for the control procedure for the above-described calibration inhibition processing at the time of starting power supply with reference to FIG. 9. First, the measurement controller 30 determines whether power supply has started (step S101). In the case where power supply has started (step S101, Yes), an initial stroke length (an initial count value by the rotary encoder 20) is set to a value outside a measurement range (step S102). After that, the measurement controller 30 determines whether the cylinder rod has passed the intermediate reset position (step S103). In the case where the cylinder rod has not passed the intermediate reset position yet (step S103, No), the malfunction detection processing unit 30*c* does not output any error (step S104) and the determination processing of step S103 is repeated although the stroke length is the value outside the measurement range. On the other hand, in the case where the cylinder rod has passed the intermediate reset position (step S103, Yes), the measurement controller further determines whether the measured stroke length (count value) is outside the measurement range (step S105). In the case where the measured stroke length is outside the measurement range (step S105, Yes), an error is output from the notification unit 31*d*, for example, (step S106), and further the determination processing of step S105 is repeated. Conversely, in the case where the measured stroke length is not outside the measurement range (step S105, No), this determination processing is repeated.

[Initial Value Setting for Rotary Encoder at the Time of Starting Power Supply to Device]

In the above-described measurement controller 30, the strokes are stored a predetermined number of times based on the count values by the A-phase, the B-phase, and the Z-phase of the rotary encoder 20, and the reference stroke length L2 and the measured stroke length L1 are calculated from the average value of the stored values. However, whether the count value immediately after starting the power supply to the measurement controller 30 is correct or not is uncertain until passing the Z-phase and the count value is cleared to zero. Therefore, immediately after starting the power supply to a measurement controller 30, stroke calibration needs to be executed using the count value of the rotary encoder 20 after passing the Z-phase. More specifically, the initial count value of the rotary encoder 20 at the time of starting the power supply to the device is stored in advance in the measurement controller 30. This initial count value may be set to a large value, such as 9000, in the case where the count value of the rotary encoder 20 in the measurement range is ±3000.

As a result, no error warning is issued because the above-described control of the calibration inhibition processing is executed at the time of starting the power supply to the device although the initial count value of the rotary encoder 20 is large at the time of starting the power supply to the device and the deviation between the actual stroke length and the measured stroke length corresponding to the initial count value is large until the cylinder rod passes the reset reference point of the rotary encoder 20.

[Rotary Encoder Reset Invalidation Setting]

In the case where "OFF", which indicates reset is set invalid, is displayed by the calibration invalidity setting unit 31*e*, the calibration processing unit 30*b* does not reset the rotary encoder 20, determining that the calibration processing is invalid.

[Screen for Assisting Stroke Operation Diagnosis by Standard Monitor]

Figure 10:
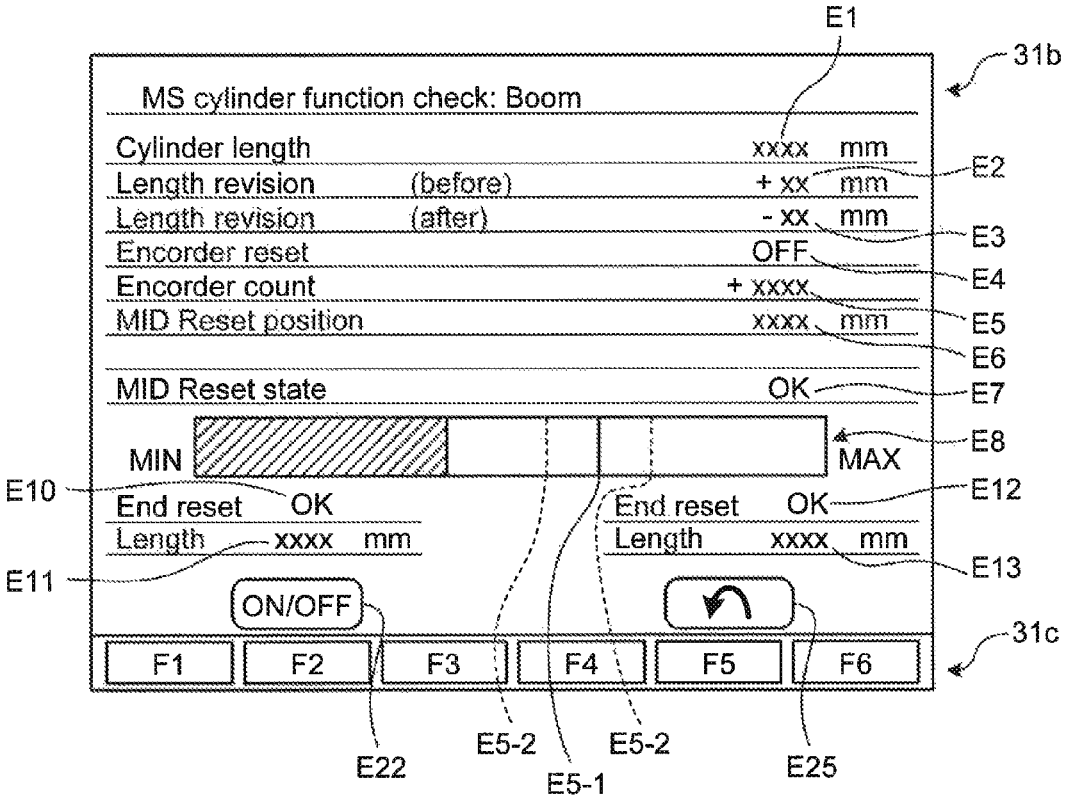
FIG. 10 is a view illustrating an example of a screen for assisting the stroke operation diagnosis according to a first embodiment, displayed on a display unit of a standard monitor.

The display unit 31*b* of the standard monitor 31 is configured to display, on a screen, the values of stroke lengths measured by the stroke sensor 10 and the state of stroke length calibration executed by the calibration processing unit 30*b*. FIG. 10 is an example of a screen for assisting the stroke operation diagnosis, displayed on the display unit 31*b*. The screen for assisting the stroke operation diagnosis illustrated in FIG. 10 is a screen obtained by sequentially selecting a service menu, an inspection menu, and a cylinder check from an initial screen, and then selecting the boom cylinder from an optional menu containing the boom cylinder, the arm cylinder, and the bucket cylinder.

In an area E1 on the screen for assisting the boom cylinder stroke operation diagnosis illustrated in FIG. 10, a distance between cylinder pins calculated based on a measurement result of the stroke sensor 10 is displayed in real time. The distance between these cylinder pins is the distance between the fixing pins PA and PB illustrated in FIG. 7. The fixing pin PA is provided on the minimum stroke end side to rotatably mount the cylinder tube 4X with respect to the vehicle body 1*a*. The fixing pin PB is provided at one end of the cylinder rod 4Y on the maximum stroke end side to rotatably mount the cylinder rod 4Y on the boom cylinder 4*f* which is the moving portion. Note that the above-described stroke length is the stroke length L illustrated in FIG. 7, which is equal to or less than a distance between the minimum stroke end position and the maximum stroke end position. Lmin is the distance between the cylinder pins, i.e., the distance up to the minimum stroke end position, and Lmax is the distance between the cylinder pins, i.e., the distance an to the maximum stroke end position.

In areas E2 and E3 below the area E1, correction values calibrated at the time of the rotary encoder 20 resetting are displayed. For instance, the difference L3 illustrated in FIG. 7 is displayed. In the area E3, a latest correction value is displayed. In the area E2, a correction value immediately before the latest correction value is displayed. These correction values are updated every time the rotary encoder 20 executes the reset. Here, three or more areas may be additionally provided, not limited to the two areas E2 and E3. A history of the correction values may be diagnosed with these values.

Further, in an area E4 below the area E3, whether the reset by the rotary encoder 20 is valid or invalid is displayed according to the setting by the calibration invalidity setting unit 31*e*. When "ON" is displayed, the reset is valid, and when "OFF" is displayed, the reset is invalid. Note that the default display is "ON". Switching between these "ON" and "OFF" is executed by toggle-operation of a function key F2 provided at the lower portion of the screen corresponding to an area E22. In this case, the function key F2 functions as the calibration invalidity setting unit 31*e*. Meanwhile, the operation unit 31*c* is arranged below the display unit 31*b* and includes six function keys F1 to F6. Conversely, function icons are displayed at the lower portion of the screen corresponding to these six function keys F1 to F6. For example, in this screen, an icon indicating a backward function is displayed in an area E25 at the lower portion of the screen corresponding to the function key F5. Meanwhile, the operation unit 31*c* includes other special function keys and ten keys. Also, the operation unit 31*c* may include some keys independent of the standard monitor 31.

Further, in an area E5 below the area E4, the count value of the rotary encoder 20 is displayed in real time. Additionally, in an area E6 below the area E5, the reference stroke length L2 detected at the time of initial calibration is displayed.

Moreover, in an area E7 below the area E6, characters "OK" are highlighted, for example, in red in the case where the rotary encoder 20 could normally calculate a measured stroke length at a time other than the initial calibration. Note that the characters "OK" are lit off when the stroke starts in the reverse direction.

Further, a bar-shaped area E8 stretching sideways is provided below the area E7. The left end of the bar indicates the minimum stroke end position, and the right end of the bar indicates the maximum stroke end position. Further, the stroke length corresponding to the value in the area E1 is transformed to a bar length and displayed. That is, the value of the stroke length measured by the stroke sensor 10 is displayed in a bar graph, and the stroke changes with continuous time are graphically displayed in the area E8. Also, the reference stroke length L2 at the time of initial calibration is indicated at a position E5-1, and an allowable stroke deviation range from this position E5-1 is indicated at positions E5-2 on the bar graph.

Further, in an area E10 on the left side below the area E8, the characters "OK" are highlighted, for example, in red same as the area E7 in the case where the reset is executed at the minimum stroke end. Also, in an area E12 on the right side below the area E8, the characters "OK" are highlighted, for example, in red same as the area E7 in the case where the reset is executed at the maximum stroke end. The highlighted indications in the areas E10 and E12 are lit off in the case where a stroke end state is gotten rid of. Further, when the reset is executed along with the highlighted indications in the areas E7, E10, and E12, the notification unit 31*d* outputs a sound.

Moreover, the distance between the cylinder pins at the minimum stroke end and the distance between the cylinder pins at the maximum stroke end, which are obtained in advance, are displayed in areas E11 and E13 below the areas E10 and area E12, respectively.

Figure 11:
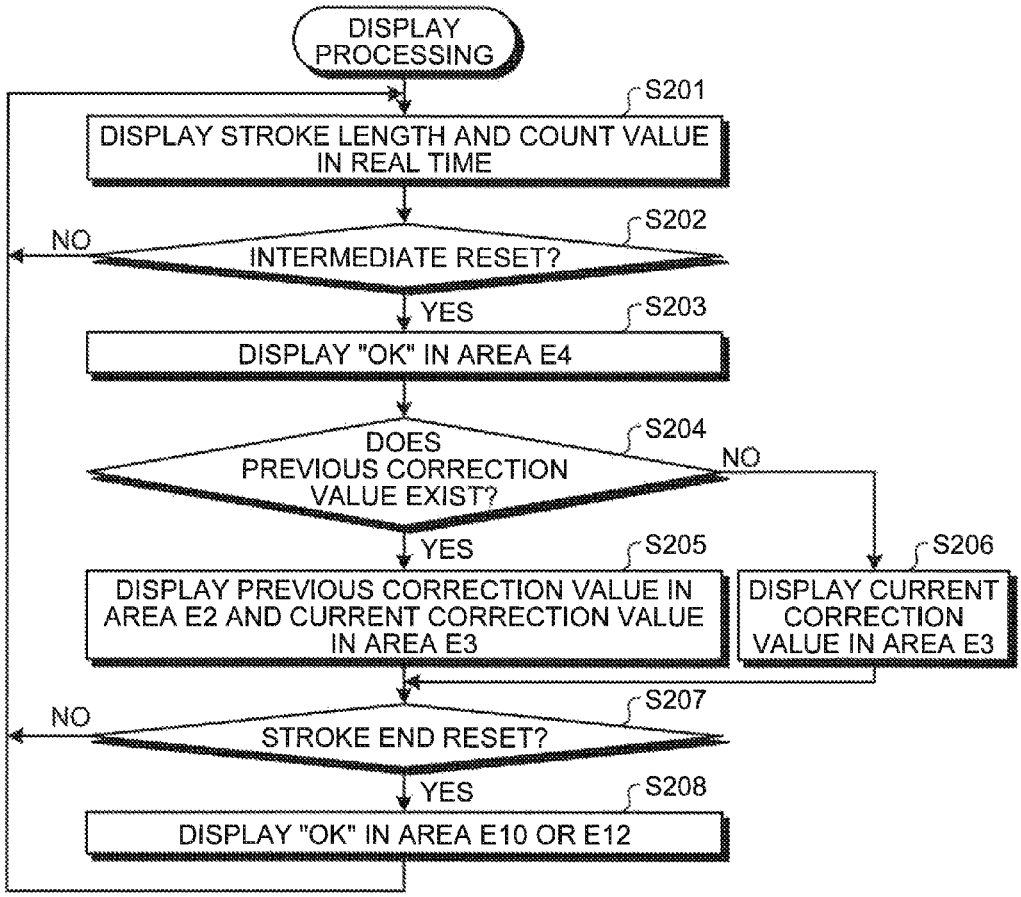
FIG. 11 is a flowchart illustrating a display processing procedure on the display unit of the standard monitor.

Now, referring to the flowchart illustrated in FIG. 11, a description will be given regarding an outline of display processing on the above-described screen for assisting the stroke operation diagnosis with reference to the flowchart. First, the standard monitor 31 acquires a current stroke length and a count value of the rotary encoder 20 from the measurement controller 30, and displays the values in the areas E1 and E5 in real time together with the bar graph display in the area E8 in real time (step S201). After that, it is determined whether there is any report received from the measurement controller 30 as to whether the intermediate reset processing has been normally executed (step S202). In the case where the intermediate reset has been normally executed (step S202, Yes), "OK" is displayed in the area E4 (step S203). Next, it is determined whether the previous correction value of the stroke length has been stored (step S204). In the case where the previous correction value has been stored (step S204, Yes), the previous correction value is displayed in the area E2, and the current correction value is displayed in the area E3 (step S205). Then the process moves to step S207. On the other hand, in the case where the previous correction value has not been stored (step S204, No), the current correction value is displayed in the area E3 (step S206) and the process moves to step S207.

After that, it is determined whether the stroke end reset has been normally executed (step S207). In the case where the stroke end reset has been normally executed (step S207, Yes), "OK" is displayed in the corresponding area E10 or E12 (step S208), and the process moves to step S201. In the case where the stroke end reset has not been normally executed (step S207, No), the process moves to step S201.

Figure 12:
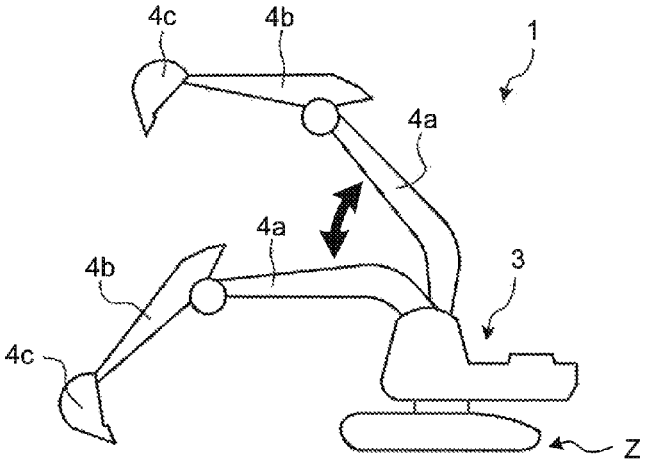
FIG. 12 is an explanatory view describing operation of the work equipment when executing calibration processing for the boom cylinder.

Additionally, a description will be given specifically regarding the diagnosis using the screen for assisting the stroke operation diagnosis in the case of moving up/down the boom cylinder 4*a*. Note that in this case, only the boom cylinder 4*a* is moved up and down as illustrated in FIG. 12.

<Stroke Sensor Malfunction Check>

First, since a default indication in the area E4 is "ON", the function key F2 is pressed and held to switch to "OFF". Then, the reset by the rotary encoder 20 is set invalid. Subsequently, the boom 4*a* is moved up with the bucket 4*c* mounted on.

In this case, the stroke length reaches the maximum stroke end by moving up the boom 4*a*, and during that time, the distance between the cylinder pins is displayed in real time in the area E1. Further, when the stroke length reaches the maximum stroke end, the stroke end reset is executed, thereby displaying a correction value in the area E2. For example, in the case where this correction value is not several millimeters, it is diagnosed that slippage may have occurred at the stroke sensor 10. Also, since the stroke length change is continuously and graphically displayed with the bar graph in the area E8, the operating condition of the stroke sensor 10 may be diagnosed based on whether the bar graph display movement is smooth or not. Meanwhile, the reset by the rotary encoder 20 may be kept valid instead of being set invalid. However, since the reset by the rotary encoder 20 becomes invalid by the invalidity setting, the diagnosis may be given by a long stroke length graphically displayed in the area E8. This eliminates some extra work, such as disconnection of a connector of the rotary encoder 20, and may provide effective diagnosis.

<Rotary Encoder Malfunction Check>

Additionally, malfunction of the rotary encoder 20 may be diagnosed by checking whether the count value of the rotary encoder 20 displayed in the area E5 has changed, or whether the Z-phase has been input in the area indicated between the positions E5-1 and E5-2 and then the count value of the rotary encoder 20 has been cleared to zero.

<Reset Operation Check: Reset Operation by Stroke End>

In addition, since the reset is executed at the maximum stroke end, "OK" is highlighted in the area E12 with issuance of a reset completion report. As a result, it is diagnosed that the reset at the maximum stroke end is normally executed. In the case where there is neither "OK" highlight indication nor any reset completion report, it may be diagnosed that the reset processing at the stroke end has not been executed.

<Reset Operation Check: Reset Operation by Reset Sensor>

Next, the boom 4*a* is moved down from the maximum stroke end. In this case, it is diagnosed that the reset processing by the rotary encoder 20 is normally executed by confirming that "OK" is highlighted in the area E7 and the reset completion report is issued at the time of resetting by the rotary encoder 20. In the case where there is neither "OK" highlight indication nor any reset completion report, it may be diagnosed that the reset processing by the rotary encoder 20 is not executed and the rotary encoder 20 is malfunctioning.

With the above-described structure, the stroke operation diagnosis may be easily and simply carried out because at least the value of the stroke length measured by the stroke sensor 10 and the calibration state by the calibration processing unit 30*b* are displayed on the screen for assisting the stroke operation diagnosis.

Particularly, the changes of the value of stroke length measured by the stroke sensor 10 are graphically displayed with the bar for a continuous time. Therefore, diagnosis for the slippage of the stroke sensor may be carried out in detail.

Also, first reset processing may be executed smoothly without any error warning and the like because the reset is inhibited until the stroke length passes the reset reference point at the time of starting power supply to the device.

Moreover, the initial stroke value of the rotary encoder 20 at the time of starting power supply to the device is set to the value outside the measurement range of the stroke length measured by the stroke sensor 10. Therefore, occurrence of erroneous reset processing due to noise and the like before the first reset processing may be prevented, and the first reset processing may be normally executed.

Second Embodiment

According to the above-described first embodiment, the stroke operation diagnosis may be simply and easily carried out by outputting the displays of the measured values of the stroke lengths and the calibration state on the screen for assisting the hydraulic cylinder stroke operation diagnosis. According to this second embodiment, an initial calibration work may be easily carried out by displaying a screen for assisting hydraulic cylinder stroke initial operation calibration work on a display unit 33*b* of an HMI monitor 33.

This initial calibration work is, as described above, to obtain and store a reference stroke length L2 at the time of factory shipment, or at the time of replacement of a reset sensor. When operating work equipment afterward, calibration processing, such as reset of a stroke length, is executed based on the reference stroke length L2 at the time of the initial calibration work. This initial calibration work has been previously executed based on, for example, a service man's own check list.

Figure 13:
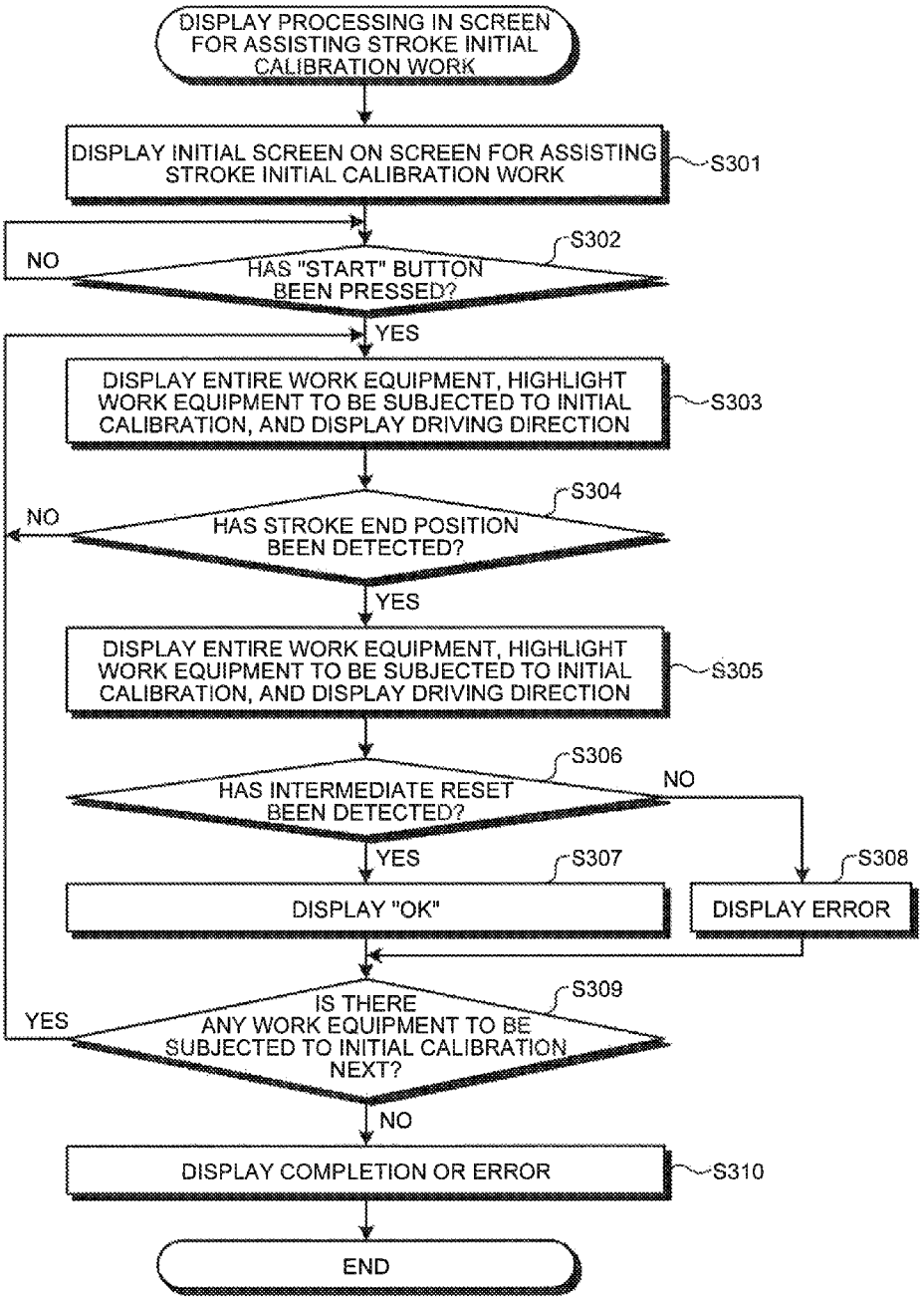
FIG. 13 is a flowchart illustrating a display processing procedure on a screen for assisting the stroke initial calibration work according to a second embodiment, displayed on a display unit of an HMI monitor.

Here, a description will be given for assisting the initial calibration work carried out based on a flowchart illustrated in FIG. 13 and examples of the screen for assisting the stroke initial calibration work illustrated in FIGS. 14-1 to 14-10. First, the screen for assisting the stroke initial calibration work illustrated in FIG. 14-1 or FIG. 14-2 is displayed on the display unit 33*b* (step S301) by selecting a service menu from an initial screen, and then selecting an initial calibration work menu.

Figures 1, 14:
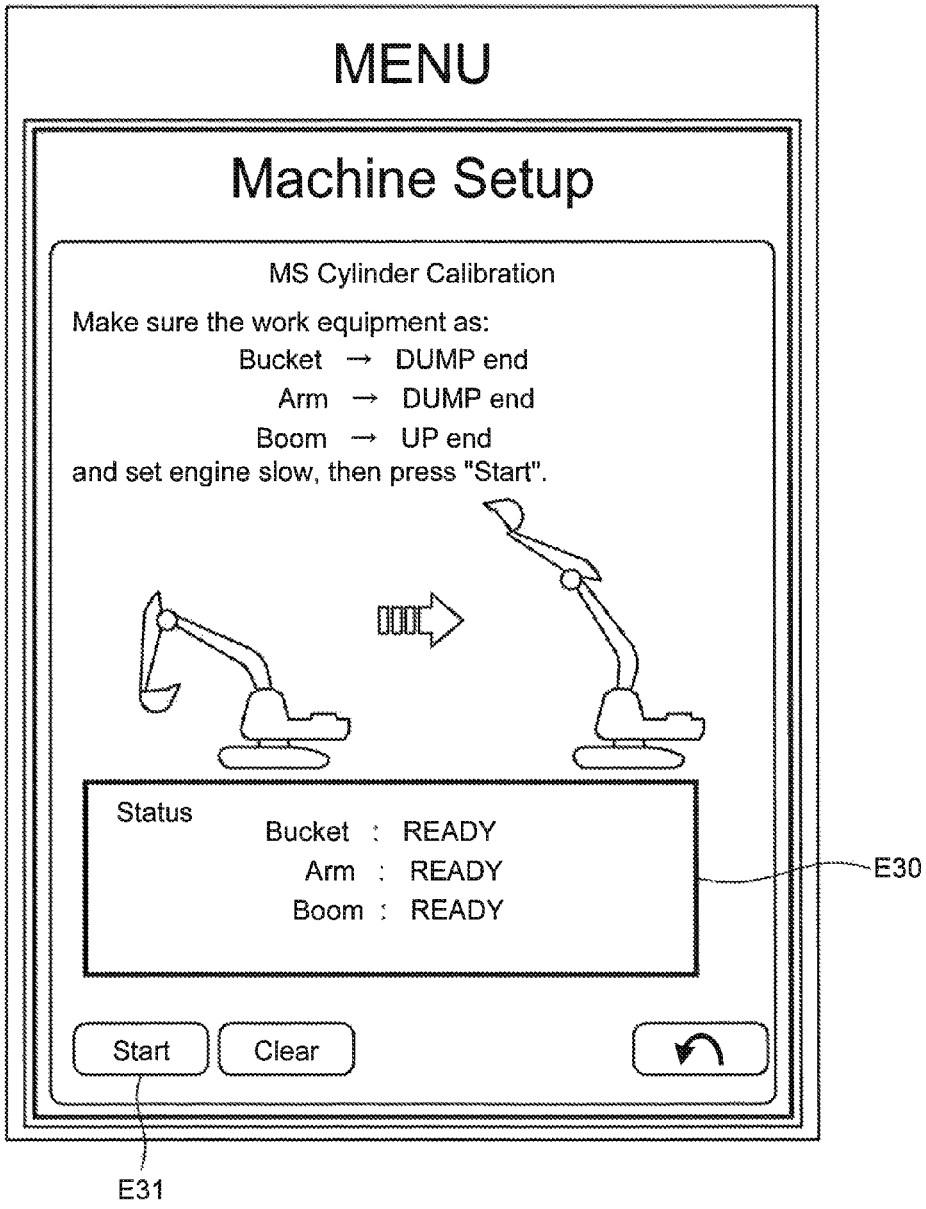
Figures 2, 14:
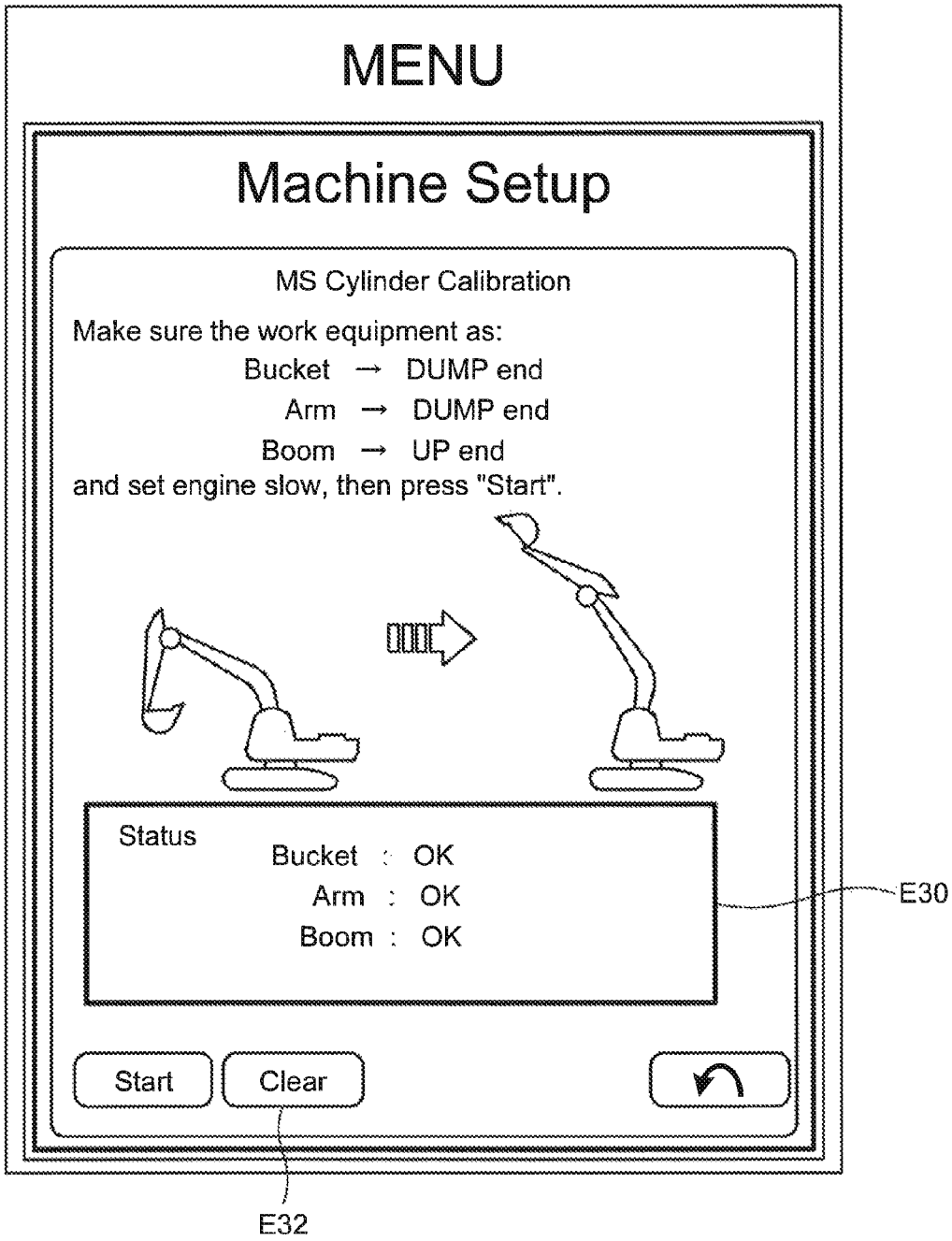
Figures 3, 14:
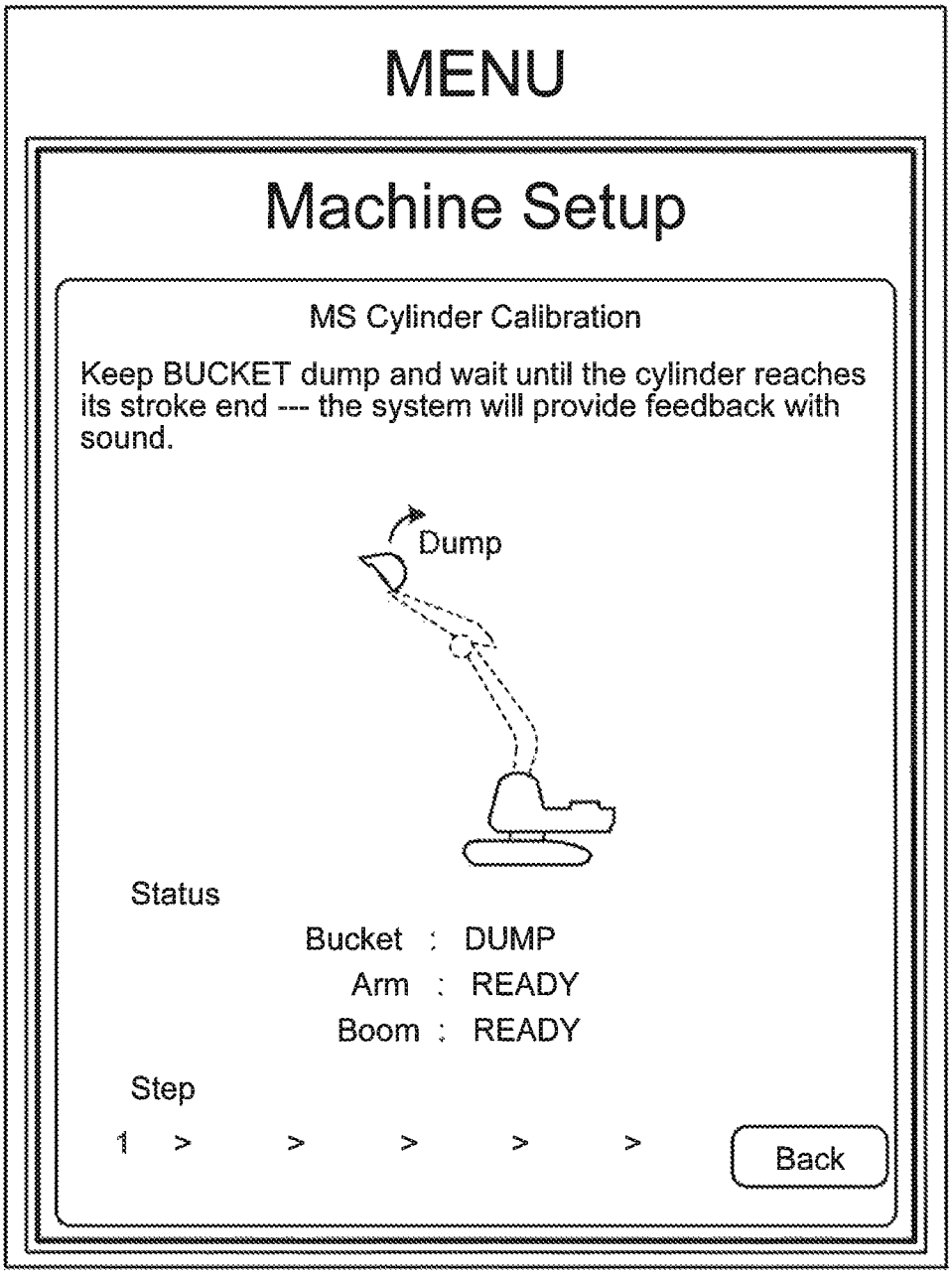
Figures 4, 14:
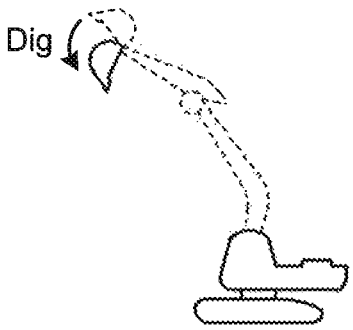
Figures 5, 14:
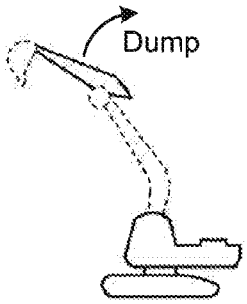
Figures 6, 14:
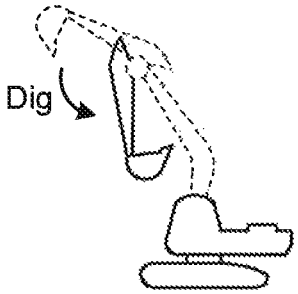
Figures 7, 14:
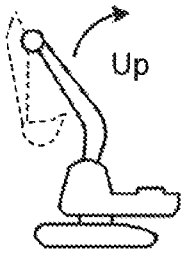
Figures 8, 14:
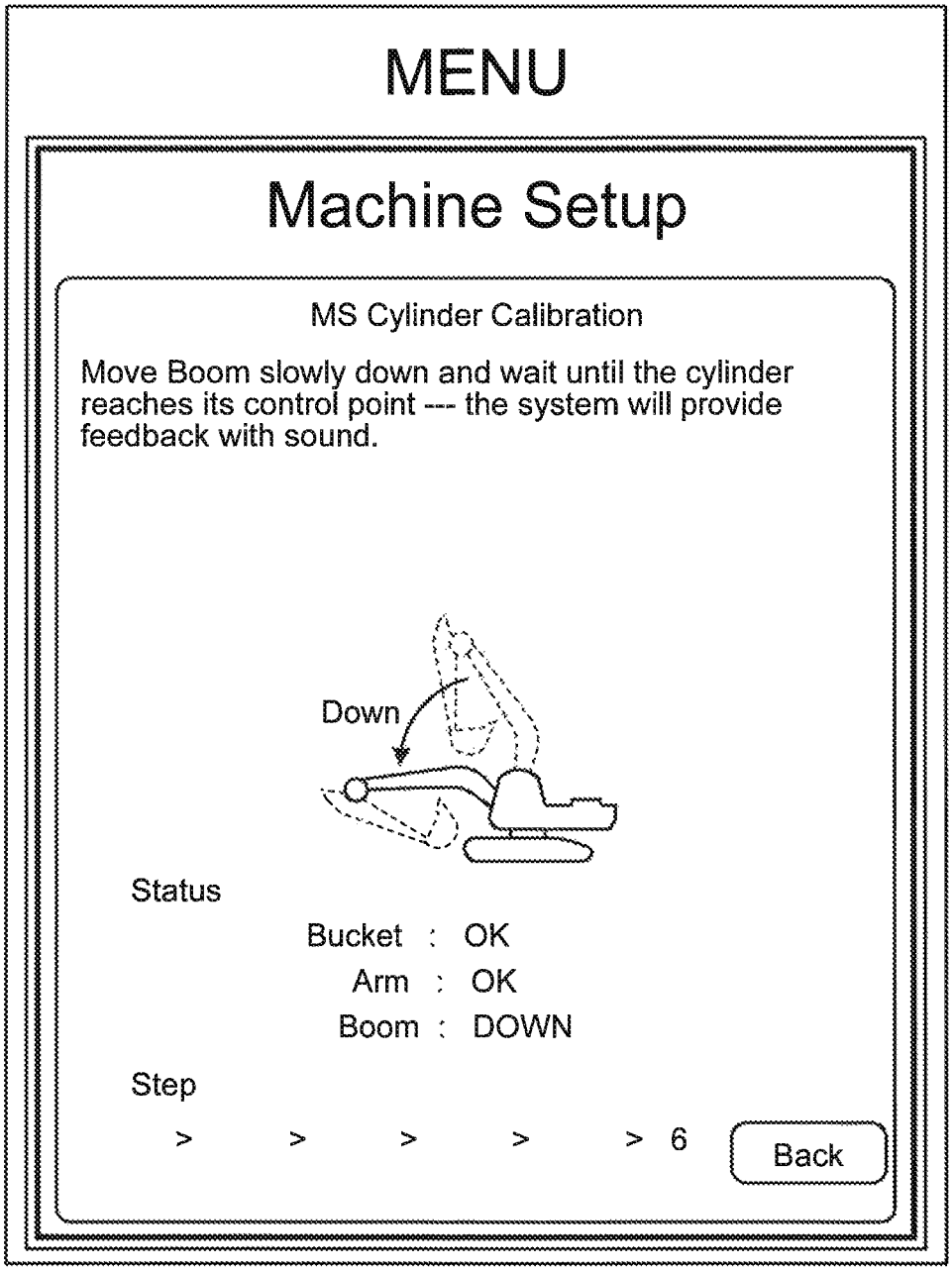
Figures 9, 14:
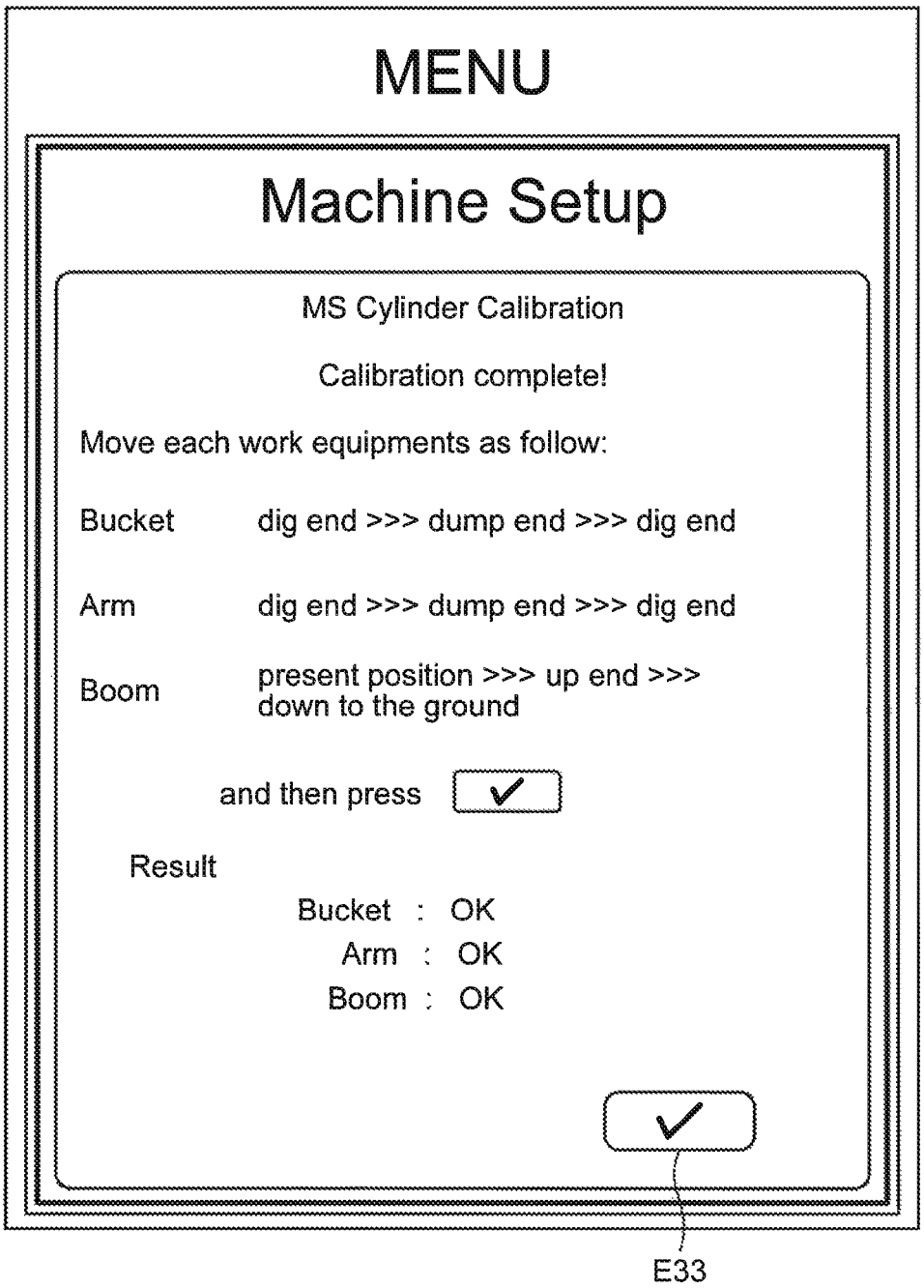
Figures 10, 14:
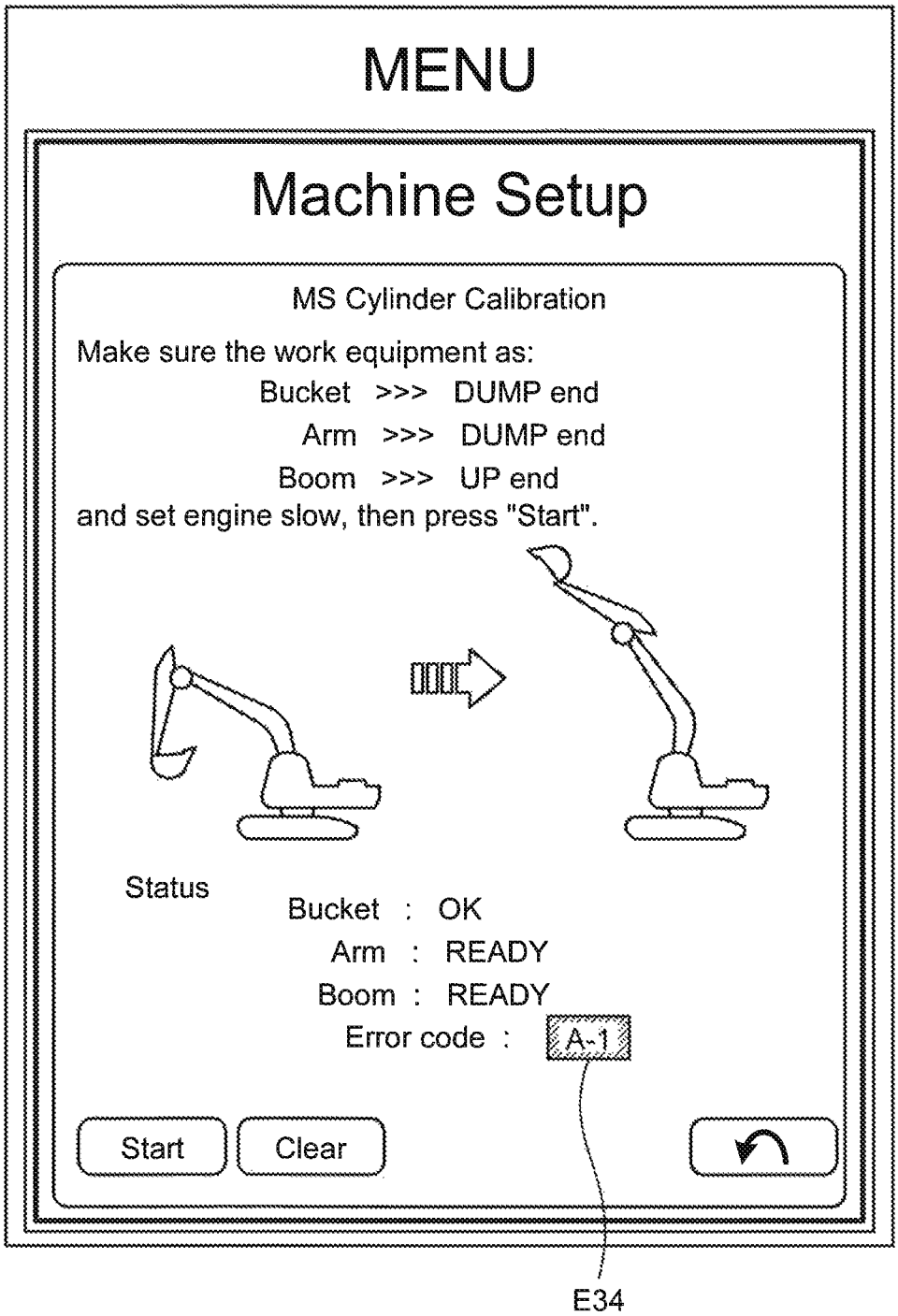

On the screen for assisting the stroke initial calibration work illustrated in FIG. 14-1, a status of an initial calibration target is indicated as "READY" in the case where the initial calibration work for the hydraulic cylinder has not been carried out. Meanwhile, on the screen for assisting the stroke initial calibration work illustrated in FIG. 14-2, the status of the initial calibration target is indicated as "OK" in the case where the initial calibration work for the hydraulic cylinder has been executed and the reference stroke length L2 has been written in a measurement controller 30. A calculation unit 31*a* of the HMI monitor 33 determines which screen, the screen in FIG. 14-1 or the screen in FIG. 14-2, is to be displayed based on whether the reference stroke length L2 has been written in the measurement controller 30.

On the screens illustrated in FIGS. 14-1 and 14-2, a brief description of operation to be executed in respective hydraulic cylinders, and instructions to set an engine speed slow and, after that, press "Start" button are displayed at the upper portion of the screen. Further, in the center of the screen, a posture of an entire excavator mounted with the hydraulic cylinders before the initial calibration work is displayed on the left side of the screen, and the posture of the same excavator after the initial calibration work is displayed on the right side of the screen. Further, at the lower portion of the screen, the status of the initial calibration work for each hydraulic cylinder is displayed in the area E30. On the screen in FIG. 14-1, "READY" is indicated for each hydraulic cylinder because the initial calibration work has not been, executed therefor yet. Also, on the screen in FIG. 14-2, "OK" is indicated for each hydraulic cylinder because the initial calibration work has already been executed.

In the case where the screen FIG. 14-1 is displayed, the "Start" button displayed in the area E31 is held down for 0.5 seconds or more in accordance with the indicated instruction (step S302). Consequently, the screen for assisting the stroke initial calibration work changes to the screen illustrated in FIG. 14-3. On the other hand, in the case where the screen in FIG. 14-2 is displayed and the initial calibration work is to be carried out, a "Clear" button displayed in the area E32 is held down for 0.5 seconds or more. Consequently, the screen changes to the screen illustrated in FIG. 14-1. In this case, the calculation unit 33*a* instructs the measurement controller 30 to reset data of the reference stroke L2 currently written. As a result, all of the status in the area E30 turns to "READY".

On the screen illustrated in FIG. 14-3, the posture of the entire excavator is graphically displayed in the center of the screen by the highlight display processing unit 33*e*, and work equipment to be calibrated, namely a bucket, is displayed with highlight, such as displayed in a different color or a different tone, so that the bucket may be discriminated from other work equipment. Further, an arrow indicating a bucket operating direction is displayed by the highlight display processing unit 33*e* (step S303). The service man operates a bucket lever in a "DUMP" direction until the bucket status changes to "DIG" based on a work description displayed at the upper portion of the screen, and be graphical display. This work stage is indicated as Step 1 at the lower portion of the screen. Subsequently, when the calculation unit 33*a* detects that the bucket stroke length has reached the stroke end position in the "DUMP" direction, which is a relief state (step S304, Yes), the calculation unit 33*a* chances the screen to the screen illustrated in FIG. 14-4. Meanwhile, it has been described that the color of the work equipment to be calibrated is changed when highlighting, but it is also possible to change a color or a tone of other work equipment.

On the screen Illustrated in FIG. 14-4, the posture of the entire excavator is graphically displayed in the center of the screen by the highlight display processing unit 33*e*, and the work equipment to be calibrated, namely the bucket, is displayed with the highlight, such as displayed in a different color or a different tone, so that the bucket may be discriminated from other work equipment. Further, an arrow indicating the bucket operating direction is displayed by the highlight display processing unit 33*e* (step S305). The service man slowly operates a bucket lever in a "DIG" direction until the bucket status changes to "OK" based on the work description indicated at the upper portion of the screen, and the graphical display. This work stage is indicated as Step 2 at the lower part of the screen. When the calculation unit 33*a* detects the reference stroke L2 while operating the bucket in the "DIG" direction (step S306, Yes) and also detects that the bucket stroke length has reached the stroke end position, which is the relief state, "OK" is displayed in the bucket status (step S307) and the calculation unit 33*a* allows this reference stroke L2 to be written in the measurement controller 30. Subsequently, a calculation unit 22*a* changes the screen to the screen illustrated in FIG. 14-5 as there is a next initial calibration target, namely the work equipment (arm) (step S309, Yes).

On the screen illustrated in FIG. 14-5, the posture of the entire excavator is graphically displayed in the center of the screen by the highlight display processing unit 33*e*, and the work equipment to be calibrated, namely an arm, is displayed with the highlight, such as in a different color or a different tone, so that the arm may be discriminated from other work equipment. Further, an arrow indicating the arm operating direction is displayed by the highlight display processing unit 33*e* (step S303). The service man operates an arm lever in a "DUMP" direction until the arm status changes to "DIG" based on the work description indicated at the upper portion of the screen, and the graphical display. This work stage is indicated as Step 3 at the lower part of the screen. Subsequently, when the calculation unit 33*a* detects that the arm stroke length has reached the stroke end position in the "DUMP" direction, which is the relief state (step S304, Yes), the calculation unit 33*a* changes the screen to the screen illustrated in FIG. 14-6.

On the screen illustrated in FIG. 14-6, the posture of the entire excavator is graphically displayed in the center of the screen by the highlight display processing unit 33*e*, and the work equipment to be calibrated, namely the arm, is displayed with highlight, such as displayed in a different color or a different tone, so that the arm may be discriminated from other work equipment. Further, an arrow indicating the arm operating direction is displayed by the highlight display processing unit 33*e* (step S305). The service man slowly operates the arm lever in a "DIG" direction until the arm status changes to "OK" based on the work description indicated at the upper portion of the screen, and the graphical display. This work stage is indicated as Step 4 at the lower part of the screen. When the calculation unit 33*a* detects the reference stroke length L2 while operating the arm in the "DIG" direction (step S306, Yes) and also detects that the arm stroke length has reached the stroke end position, which is the relief state, "OK" is displayed in the arm status (step S307) and the calculation unit 33*a* allows this reference stroke length L2 to be written in the measurement controller 30. Subsequently, the calculation unit 33*a* changes the screen to the screen illustrated in FIG. 14-7 as there is a next initial calibration target, namely the work equipment (boom) (step S309, Yes).

On the screen illustrated in FIG. 14-7, the posture of the entire excavator is graphically displayed in the center of the screen by the highlight display processing unit 33*e*, and the work equipment to be calibrated, namely a boom, is displayed with the highlight, such as displayed in a different color or a different tone, so that the boom may be discriminated from other work equipment. Further, an arrow indicating the boom operating direction is displayed by the highlight display processing unit 33*e* (step S303). The service man operates a boom lever in a "UP" direction until the boom status changes to "DOWN" based on the work description indicated at the upper portion of the screen, and the graphical display. This work stage is indicated as Step 5 at the lower part of the screen. Subsequently, when the calculation unit. 33*a* detects that the boom stroke length has reached the stroke end position in the "UP" direction, which is the relief state (step S304, Yes), the calculation unit 33*a* changes the screen to the screen illustrated in FIG. 14-8.

On the screen illustrated in FIG. 14-8, the posture of the entire excavator is graphically displayed in the center of the screen by the highlight display processing unit 33*e*, and the work equipment to be calibrated, namely the boom, is displayed with the highlight, such as in a different color or a different tone, so that the boom may be discriminated from other work equipment. Further, an arrow indicating the boom operating direction is displayed by the highlight display processing unit 33*e* (step S305). The service man slowly operates the boom lever in a "DOWN" direction until the work equipment reaches the ground based on the work description indicated at the upper portion of the screen, and the graphical display. This work stage is indicated as Step 6 at the lower part of the screen. When the calculation unit 33*a* detects the reference stroke length L2 while operating the boom in the "DOWN" direction (step S306, Yes), "OK" is displayed in the boom status (step S307) and the calculation unit 33*a* allows this reference stroke length L2 to be written in the measurement controller 30. Subsequently, the calculation unit 33*a* changes the screen to the screen illustrated in FIG. 14-9 as there is no more work equipment to be subject to initial calibration (step S309, No).

Figure 9:
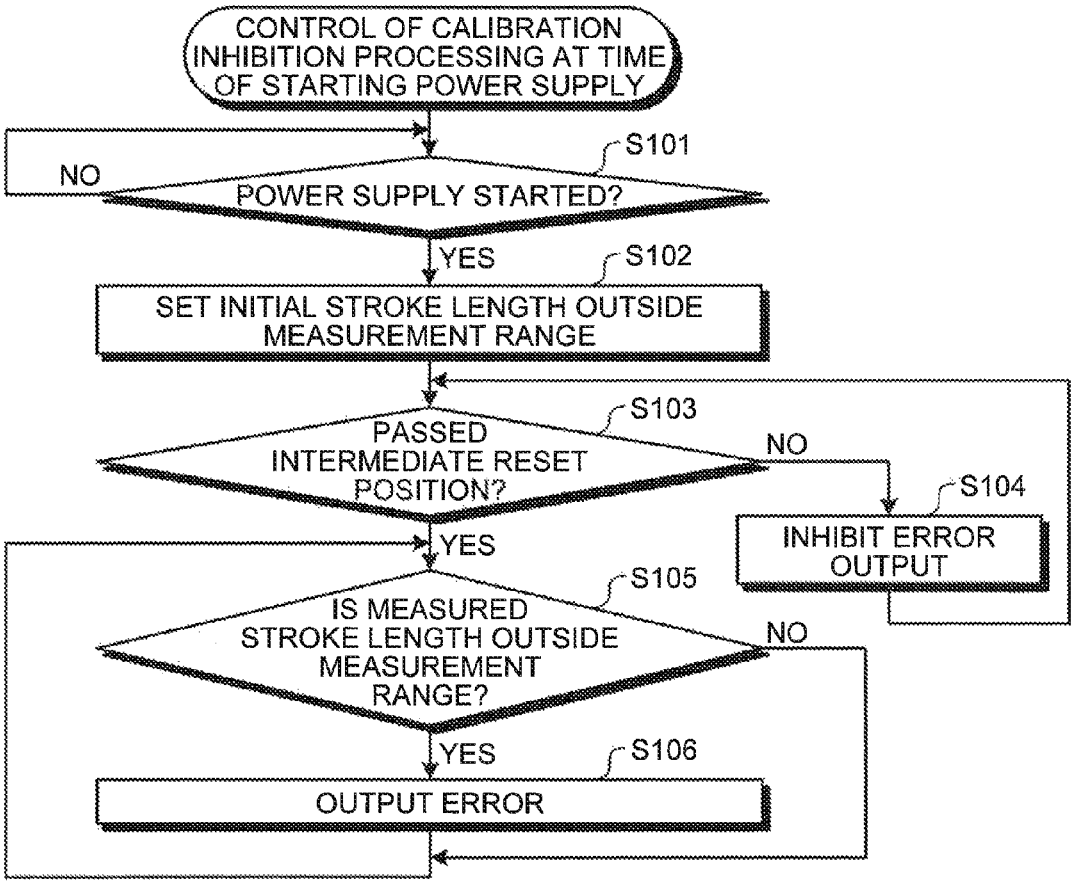
FIG. 9 is a flowchart illustrating a calibration inhibition processing control procedure at the time of starting power supply.

On the screen illustrated in FIG. 14-9, "OK" is displayed in the status of all of the hydraulic cylinders, and also a report indicating completion of the initial calibration work is displayed (step S310). Further, the bucket, the arm, and the boom are reciprocated to recognize the reset positions. After reciprocating, a check button in the area E33 is pressed, thereby completing the initial calibration work. Then, the calculation unit 33*a* allows the screen to return to the menu screen.

Meanwhile, the above-described initial calibration work procedure has been carried out in the following order: the bucket, the arm, and the boom, but the order is not limited thereto. For example, in the case where the initial calibration work is carried out for the arm, the initial calibration work for the arm is completed. Then, the screen illustrated in FIG. 14-9 is displayed in the case where the initial calibration work for all of the hydraulic cylinders has been completed by carrying out the initial calibration work for other calibration targets, regardless of the order of the initial calibration work procedure.

Further, in the case where the calibration for the calibration target is not successful (step S306, No), the screen is changed to the screen illustrated in FIG. 14-10. Then, the calculation unit 33*a* displays an error code in the area E34 (step S308). This may notify an error content corresponding to the error code and how to resolve the error. The error content corresponding to this error code and how to resolve the error may be automatically displayed on the screen. Meanwhile, in the case where the calibration for the calibration target is not successful, the reference stroke length L2 currently stored is maintained and will not be updated.

Further, in the case where the initial calibration work for the hydraulic cylinders has not been completed, the calculation unit 33*a* issues a warning to call attention via a notification unit 33*d*. The calculation unit 33*a* determines whether the initial calibration work has been completed based on whether all of the reference stroke lengths L2 have been written in the measurement controller 30.

Additionally, in the case where the HMI monitor 33 is capable of receiving information from a communication satellite via a position information detector 19 and an antenna 9, the position information detector 19 calculates the position and orientation of the excavator 1 based on the received position information, and outputs the calculated position and orientation as vehicle position information to a main controller 32 and the HMI monitor 33. On the other hand, work position information regarding the horizontal and vertical positions of a cutting edge of the work equipment 4 is acquired at the measurement controller 30, and is output to the main controller 32 and to the HMI monitor 33. The main controller 32 and the HMI monitor 33 may automatically control the cutting edge of the work equipment 4 based on the vehicle position information, the work position information, and further three-dimensional work information. In the event of communication error between the main controller 32 and the HMI monitor 33 during the initial calibration work, a pop-up error screen is displayed on the screen. In this case, the initial calibration is stopped by pressing a button corresponding to "backward" in the pop-up screen, and then the screen returns to the menu screen. In such a case, the initial calibration work using the screen for assisting the stroke initial calibration work is to be carried out again after the error is recovered.

According to this second embodiment, the calculation unit 33*a* of the HMI monitor 33 changes the screen for assisting the stroke initial calibration work based on detection of the work equipment operating status as well as the input from the operation unit 33*c*. Further, the calculation unit 33*a* controls the stroke length L2, i.e., the calibration result, to be written, and also the error screen to be displayed. As a result, the service man operates the work equipment in accordance with the screen for assisting the stroke initial calibration work, and may complete the initial calibration work only by making the simple input from the operation unit 33*c*.

Meanwhile, according to the above-described first and second embodiments, it is preferable that the reset by the reset sensor or the reset at the stroke end be executed by reset processing for only one-direction stroke, not for bi-directional stroke. This is because the reset processing itself is complicated since the reset position has directivity and the reset processing needs to be executed per direction. For instance, the reset processing for the bucket cylinder 4*d* and the arm cylinder 4*e* is to be executed only in a direction the cylinder extends, and the reset processing for the boom cylinder 4*f* is to be executed only in a direction the cylinder contracts. The reason why the reset processing for the boom cylinder 4*f* is to be executed in the direction the cylinder contracts is that, since the work equipment position is lower than the ground level, normally the stroke end on the contracting side of the boom cylinder 4*f* may not be used. Additionally, the screen for assisting an initial configuration work may be displayed on the standard monitor 31 although the screen for assisting the initial calibration work is displayed on the HMI monitor 33 according to the second embodiment.

REFERENCE SIGNS LIST

1 excavator
1*a* vehicle body
2 lower traveling body
2*a* crawler
3 upper swing body
3*a* engine
4 work equipment
4*a* boom
4*b* arm
4*c* bucket
4*d* bucket cylinder
4*e* arm cylinder
4*f* boom cylinder
4X cylinder tube
4W cylinder head
4Y cylinder rod
4V piston
5 cab
6 engine room
7 counterweight
8 driver's seat
9 antenna
10 stroke sensor
11 rotary roller
12 rotary central shaft
13 rotation sensing portion
13*a* magnet
13*b* Hall IC
14 case
19 position information detector
20 rotary encoder
20*a* magnetic force sensor
25 disc portion
25*a*, 25*b* light transmitting portion
26 light emitting portion
27 light receiving portion
27*a* light receiving element
30 measurement controller
30*a* stroke end detection processing unit
30*b* calibration processing unit
30*c* malfunction detection processing unit
31 standard monitor
31*a*, 33*a* calculation unit
31*b*, 33*b* display unit
31*c*, 33*c* operation unit
31*d*, 33*d* notification unit
31*e* calibration invalidity setting unit
32 main controller

33 HMI monitor
33*e* highlight display processing unit
40H rod-side oil chamber
40B cap-side oil chamber
61 magnetic force sensor
63 magnet
101, 101R, 101L operation lever device
101Ra, 101Rb operation lever
101Rb, 101Lb detector
102 control valve
103 hydraulic pump
103*a* swash plate
104 servo mechanism
105 engine driving mechanism
106 discharge oil passage
107, 108 oil passage
109, battery
110 engine key switch
d rotation radius
E1 to E8, E10, E12, E22, E30 to E34 area
F1, F2, F5 function key
L stroke length
measured stroke length
L2 reference stroke length
L3 difference
N network
PA, PB fixing pin

The invention claimed is:

1. An apparatus for hydraulic cylinder stroke initial calibration work, comprising:

moving portions rotatably supported in series with respect to a vehicle body;

a hydraulic cylinder configured to rotatably support at least one of the moving portions and arranged between the vehicle body and at least one of the moving portions, or between the moving portions;

a stroke sensor mounted on the hydraulic cylinder and configured to measure a stroke length of the hydraulic cylinder;

a reset sensor configured to measure a reset reference point to reset a value of the stroke length measured by the stroke sensor;

a stroke end detection processing unit configured to detect a stroke end position of the hydraulic cylinder;

a calibration processing unit configured to calibrate the measured value of the stroke length when the reset reference point and/or the stroke end position is detected; and a monitor operatively connected to the apparatus and configured to display an entire work machine mounted with the hydraulic cylinder when an initial calibration work for the hydraulic cylinder is carried out; and the monitor having a highlight display processing unit configured to highlight at least of the moving portions to drive the hydraulic cylinder to be calibrated along with an indication of a driving direction.

2. The apparatus for hydraulic cylinder stroke initial calibration work according to claim 1, wherein completion of the calibration is displayed when calibration of the hydraulic cylinder to be calibrated is completed.

3. The apparatus for hydraulic cylinder stroke initial calibration work according to claim 1, wherein the monitor issues a warning to call attention when an initial calibration work for the hydraulic cylinder is not completed.

4. A method for hydraulic cylinder stroke initial calibration work, wherein when measuring a stroke length of a hydraulic cylinder by a stroke sensor mounted on the hydraulic cylinder, the initial calibration work to calibrate the stroke length is assisted by detecting a reset reference point by a reset sensor and/or a stroke end position of the hydraulic cylinder, and when the hydraulic cylinder initial calibration work is carried out, an entire work machine mounted with the hydraulic cylinder is displayed, and at least one moving portion to drive the hydraulic cylinder to be calibrated is highlighted along with an indication of a driving direction, and when the calibration of the hydraulic cylinder to be calibrated is completed, completion of the calibration is displayed.

5. The method for hydraulic cylinder stroke initial calibration work according to claim 4, wherein a warning to call attention is issued when an initial calibration work for the hydraulic cylinder is not completed.

* * * * *